US011245195B2

(12) United States Patent
Kasahara et al.

(10) Patent No.: US 11,245,195 B2
(45) **Date of Patent: *Feb. 8, 2022**

(54) PHASE CONTROL PLATE

(71) Applicant: NEC Corporation, Tokyo (JP)

(72) Inventors: Yoshiaki Kasahara, Tokyo (JP); Eiji Hankui, Tokyo (JP); Hiroshi Toyao, Tokyo (JP); Keishi Kosaka, Tokyo (JP); Mingqi Wu, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/757,058

(22) PCT Filed: Oct. 23, 2017

(86) PCT No.: PCT/JP2017/038130

§ 371 (c)(1),
(2) Date: Apr. 17, 2020

(87) PCT Pub. No.: WO2019/082230

PCT Pub. Date: May 2, 2019

(65) Prior Publication Data

US 2020/0343644 A1 Oct. 29, 2020

(51) Int. Cl.

| | |
|---|---|
| ***H01Q 15/02*** | (2006.01) |
| ***H01Q 15/10*** | (2006.01) |
| ***H01Q 15/00*** | (2006.01) |

(52) U.S. Cl.

CPC ..... *H01Q 15/10* (2013.01); *H01Q 15/0026* (2013.01); *H01Q 15/0086* (2013.01)

(58) Field of Classification Search

CPC .... H01Q 15/10; H01Q 15/00; H01Q 15/0026; H01Q 15/0086; H01Q 15/02; H01Q 15/12

See application file for complete search history.

(56) References Cited

U.S. PATENT DOCUMENTS 5,140,338 A * 8/1992 Schmier ..... H01Q 1/42 343/700 MS
6,483,481 B1 * 11/2002 Sievenpiper ..... H01Q 15/008 343/700 MS (Continued)

FOREIGN PATENT DOCUMENTS

CN 103296476 A 9/2013
JP 2011-112942 A 6/2011

(Continued)

OTHER PUBLICATIONS

International Search Report for PCT Application No. PCT/JP2017/038130, dated Jan. 9, 2018.

(Continued)

*Primary Examiner* — Tho G Phan
(74) *Attorney, Agent, or Firm* — Sughrue Mion, PLLC

(57) ABSTRACT

The present invention provides a phase control plate including n layers (n≥4) of overlapping admittance sheets (10-1 to 10-6) each of which includes a plurality of plane unit cells, in which an admittance of a first plane unit cell included in an admittance sheet in a layer a (1≤a≤n) and an admittance of a second plane unit cell being included in an admittance sheet in a layer b (1≤b≤n and b≠a) and overlapping the first plane unit cell are different from each other.

8 Claims, 29 Drawing Sheets

(56) References Cited

U.S. PATENT DOCUMENTS

| | | | | |
|---|---|---|---|---|
| 6,774,867 | B2 * | 8/2004 | Diaz | H01Q 7/00 343/700 MS |
| 7,071,889 | B2 * | 7/2006 | McKinzie, III | H01Q 9/0421 343/700 MS |
| 7,253,788 | B2 * | 8/2007 | Choi | H01Q 15/006 343/754 |
| 10,193,233 | B1 * | 1/2019 | Gregoire | H01Q 15/14 |
| 2011/0098033 | A1 | 4/2011 | Britz et al. | |
| 2012/0326800 | A1 | 12/2012 | Liu et al. | |
| 2013/0050058 | A1 | 2/2013 | Liu et al. | |
| 2015/0138009 | A1 | 5/2015 | Liu et al. | |
| 2015/0303584 | A1 | 10/2015 | Liu et al. | |
| 2016/0011307 | A1 | 1/2016 | Cassecasse et al. | |
| 2016/0361002 | A1 | 12/2016 | Palikaras et al. | |

FOREIGN PATENT DOCUMENTS

| | | | |
|---|---|---|---|
| JP | 2013-509097 | A | 3/2013 |
| JP | 2015-231184 | A | 12/2015 |
| JP | 2016-020899 | A | 2/2016 |
| JP | 2017-507722 | A | 3/2017 |
| WO | 2013/029326 | A1 | 3/2013 |

OTHER PUBLICATIONS

Ding et al., Metasurface for polarization and phase manipulation of the electromagnetic wave simultaneously, 2016 International Conference on Electromagnetics in Advanced Applications (ICEAA), IEEE, Sep. 19, 2016, pp. 393, 394, China.

Martini et al., Comparison of different numerical models for wolumetric metamaterials, Antennas and Propagation (EUCAP), 2012 6th European Conference, IEEE, Mar. 26, 2012, pp. 2677-2679, Italy.

* cited by examiner

EQUIVALENT CIRCUIT DIAGRAM FOR SIX-LAYER STRUCTURE

EQUIVALENT CIRCUIT DIAGRAM FOR n-LAYER STRUCTURE

PHASE CONTROL PLATE

This application is a National Stage Entry of PCT/JP2017/038130 filed on Oct. 23, 2017, the contents of all of which are incorporated herein by reference, in their entirety.

TECHNICAL FIELD

The present invention relates to a phase control plate controlling a phase of an electromagnetic wave.

BACKGROUND ART

A technology using a dielectric lens is known as a technology of controlling a phase of an electromagnetic wave.

A technology related to the present invention is disclosed in Patent Document 1. Patent Document 1 discloses a device for coupling of an electromagnetic radiation from outside to inside of a biological matter or from inside to outside of the biological matter. The device includes a first metamaterial. The first metamaterial includes a substrate having a thickness equal to or less than a first wavelength of the electromagnetic radiation and a plurality of elements supported by the substrate. Each of the plurality of elements has a first length equal to or less than the first wavelength of the electromagnetic radiation, and at least two of the plurality of elements are not the same.

RELATED DOCUMENT

Patent Document

[Patent Document 1] Japanese Unexamined Patent Application Publication (Translation of PCT Application) No. 2017-507722

SUMMARY OF THE INVENTION

Technical Problem

A dielectric lens has a certain thickness and therefore hinders thinning of a device. An object of the present invention is to achieve phase control over a range from 0 to 360 degrees without using a dielectric lens.

Solution to Problem

The present invention provides a phase control plate including n layers ($n \geq 4$) of overlapping admittance sheets each of which includes a plurality of plane unit cells, in which an admittance of a first plane unit cell included in an admittance sheet in a layer a ($1 \leq a \leq n$) and an admittance of a second plane unit cell being included in an admittance sheet in a layer b ($1 \leq b \leq n$ and $b \neq a$) and overlapping the first plane unit cell are different from each other.

Advantageous Effects of the Invention

The present invention can achieve phase control over a range from 0 to 360 degrees without using a dielectric lens.

BRIEF DESCRIPTION OF THE DRAWINGS

The aforementioned object, other objects, features and advantages will become more apparent by the following preferred example embodiments and accompanying drawings.

DESCRIPTION OF EMBODIMENTS

First Example Embodiment

A phase control plate according to the present example embodiment is configured with n layers ($n \geq 4$) of overlapping admittance sheets each of which includes a plurality of plane unit cells. A dielectric layer exists between two layers of admittance sheets. In other words, the phase control plate has a structure including n layers of admittance sheets and (n−1) layers of dielectric layers, and the admittance sheets and the dielectric layers are alternately laminated.

Figure 1:
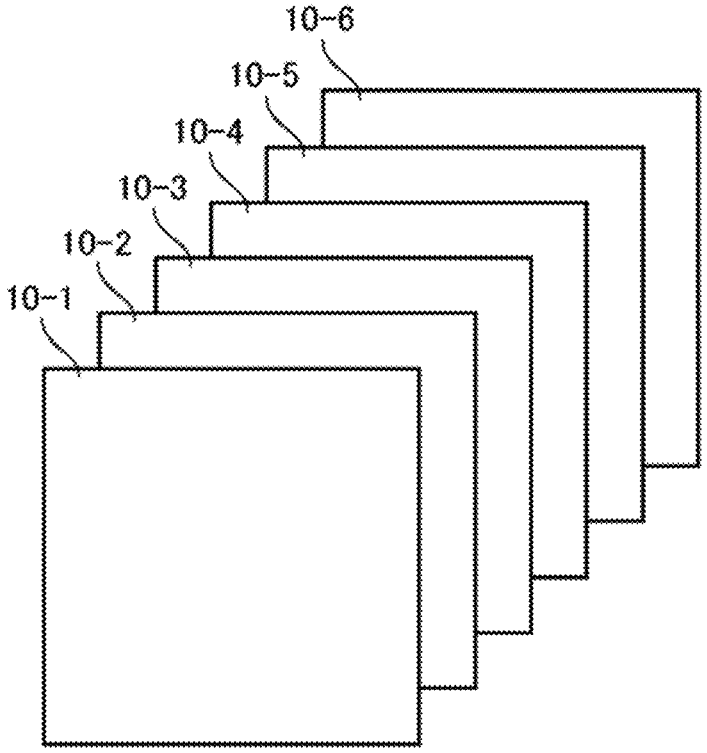
FIG. 1 is a diagram for illustrating an example of a structure of a phase control plate according to the present example embodiment.

FIG. 1 discloses six layers of admittance sheets 10-1 to 10-6. For example, the phase control plate according to the present example embodiment has a structure in which the six layers of admittance sheets 10-1 to 10-6 and five layers of dielectric layers are alternately laminated. Note that the phase control plate according to the present example embodiment may have a structure in which five layers of admittance sheets and four layers of dielectric layers are alternately laminated, a structure in which four layers of admittance sheets and three layers of dielectric layers are alternately laminated, or another structure. Further, while the illustrated admittance sheet has a plane shape being a quadrangle, the plane shape may be another shape such as a circle.

Each admittance sheet has a metal pattern. A metal pattern has a structure in which a plurality of types of plane unit cells including metal are two-dimensionally arranged in accordance with a certain rule or randomly. Note that, for example, a dielectric exists in a part other than metal in an admittance sheet. A size of a plane unit cell is sufficiently small compared with a wavelength of an electromagnetic wave. Consequently, a set of plane unit cells functions as an electromagnetic continuous medium. By controlling a magnetic permeability and a dielectric constant with the structure of the metal pattern, a refractive index (phase velocity) and an impedance can be independently controlled.

An example of a structure of the phase control plate will be described.

Figure 2:
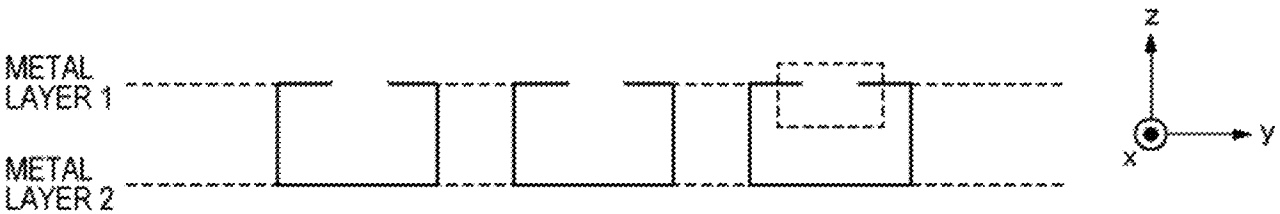
FIG. 2 is a diagram for illustrating an example of a structure for controlling a magnetic permeability.

First, referring to FIG. 2, an example of a structure for controlling a magnetic permeability will be described. FIG. 2 is a diagram illustrating a structure of a so-called split-ring resonator. The structure in FIG. 2 is configured with two layers of admittance sheets, a dielectric layer between the two layers of admittance sheets, and metals positioned in the dielectric layer. The admittance sheets and the dielectric layer extend in an xy-plane in the diagram. Then, an admittance sheet, the dielectric layer, and an admittance sheet are laminated in a z direction in the diagram. A metal layer 1 is a metal pattern of a first admittance sheet. A metal layer 2 is a metal pattern of a second admittance sheet. The metal positioned in the dielectric layer electrically connects the metal layer 1 and the metal layer 2.

A linear or plate-shaped metal is formed in the metal layer 2. Two linear or plate-shaped metals separated from each other are formed in the metal layer 1. Then, the respective two metals separated from each other in the metal layer 1 are connected to the same metal in the metal layer 2, for example, through vias. As illustrated, one metal in the metal layer 2, two metals in the metal layer 1, and two vias are connected in such a way as to form a partially opened ring-shaped metal (split ring) when observed from an x direction. FIG. 2 illustrates a scene in which such split-ring structures are arranged in a y direction. The split-ring structures may be arranged in the x direction.

When a magnetic field Bin having a component in the x direction is applied to the structure illustrated in FIG. 2, ring-shaped current Jind flows along a split ring. A split ring is described by a circuit model of a series LC resonator. An inductance L constituting the series LC resonator can be adjusted by adjusting a length of a ring-shaped metal in a circumferential direction. Further, a capacitance C can be adjusted by adjusting a width of the opening part of a ring-shaped metal (a part enclosed by wavy lines in FIG. 2), a line width of the metal, and the like. The current Jind can be adjusted by adjustment of L and C. Then, by adjusting the current Jind, a magnetic field generated by the current can be adjusted. In other words, a magnetic permeability can be controlled.

Figure 3:
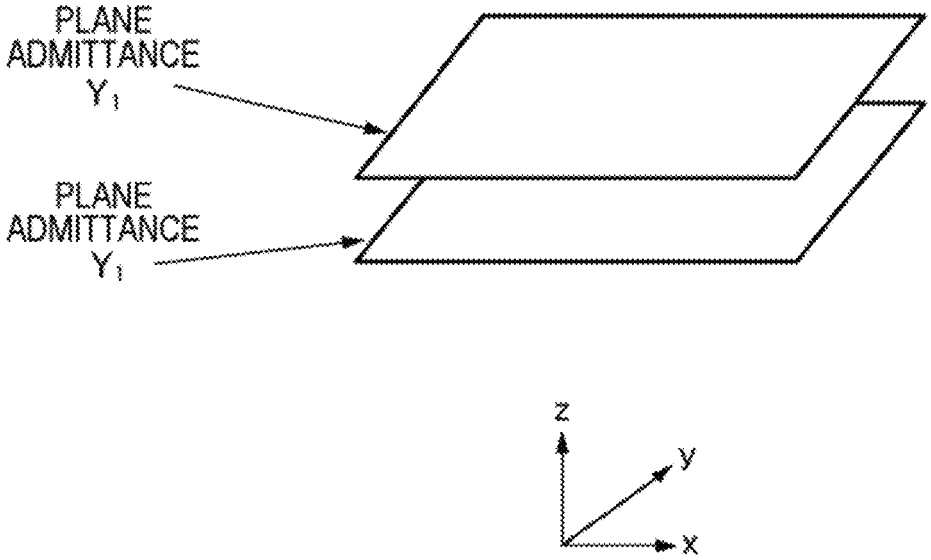
FIG. 3 is a diagram for illustrating an example of a structure for controlling a magnetic permeability.

Next, referring to FIG. 3, another example of a structure for controlling a magnetic permeability will be described. The structure in FIG. 3 is configured with two layers of admittance sheets and a dielectric layer between the two layers of admittance sheets. The admittance sheets and the dielectric layer extend in an xy-plane in the diagram. Then, an admittance sheet, the dielectric layer, and an admittance sheet are laminated in a z direction in the diagram.

The admittance sheet includes a plate-shaped metal in order to control an impedance (admittance). When a magnetic field Bin having a component parallel with two plate-shaped metals is applied between the two layers of admittance sheets, current Jind flows in the respective two plate-shaped metals in directions opposite to each other. Currents induced by the magnetic field Bin always flow in directions opposed to each other and therefore can induce a magnetic field. In other words, the currents can be equivalently considered as a ring current. The current Jind can be adjusted by adjusting admittances of the two layers of admittance sheets. Then, by adjusting the current Jind, a magnetic field generated by the current can be adjusted. In other words, a magnetic permeability can be controlled. Adjustment of the admittances of the admittance sheets can be achieved by adjusting an inductance L and a capacitance C formed by patterns of the plate-shaped metals.

Figure 4:
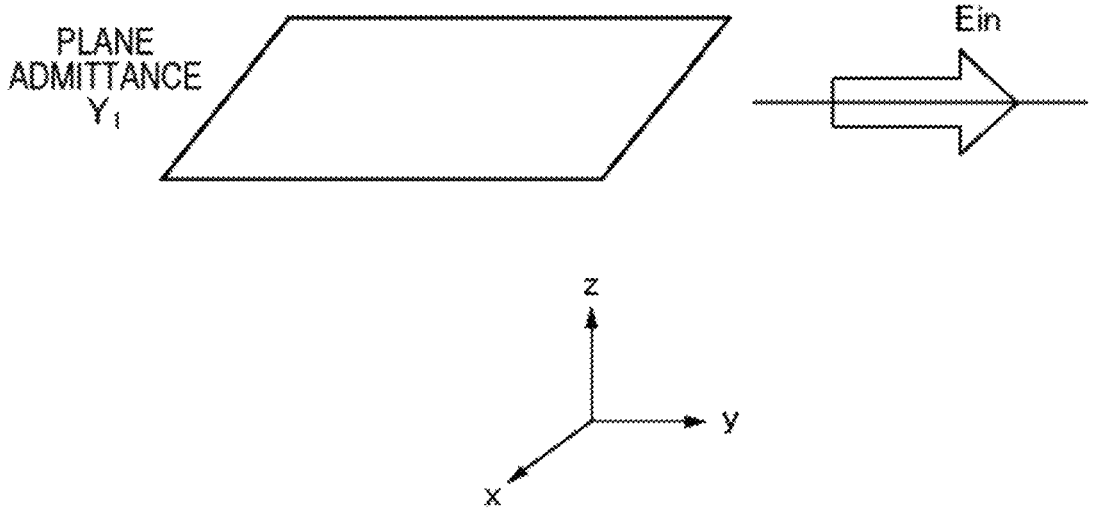
FIG. 4 is a diagram for illustrating an example of a structure for controlling a dielectric constant.

Next, referring to FIG. 4, an example of a structure for controlling a dielectric constant will be described. The structure for controlling a dielectric constant is configured with a single-layer admittance sheet. An admittance sheet extends in an xy-plane in the diagram. The admittance sheet has a metal pattern for controlling an impedance (admittance). A potential difference is induced between two points in an admittance adjustment plane of the admittance sheet by an electric field Ein in a direction as indicated in FIG. 4. By adjusting current Jind flowing due to the potential difference by adjusting the admittance of the admittance sheet, an electric field generated by the current can be adjusted. In other words, a dielectric constant can be controlled.

The above description tells that a magnetic permeability is controlled by two layers of admittance sheets and a dielectric constant is controlled by a single-layer admittance sheet. An impedance and a phase constant are given by Equations (1) and (2) described below by use of a dielectric constant and a magnetic permeability. Consequently, an amount of phase shift being a delay in the phase control plate can be controlled by controlling the phase constant while matching a vacuum impedance to an impedance of the phase control plate (in other words, while keeping a reflection-free condition) by controlling the dielectric constant and the magnetic permeability.

[Math. 1]

$$\eta eff = \sqrt{\frac{\mu eff}{\varepsilon eff}} \tag{1}$$

-continued

[Math. 2]

$$keff = \omega\sqrt{\varepsilon eff\,\mu eff} \quad (2)$$

Figure 5:
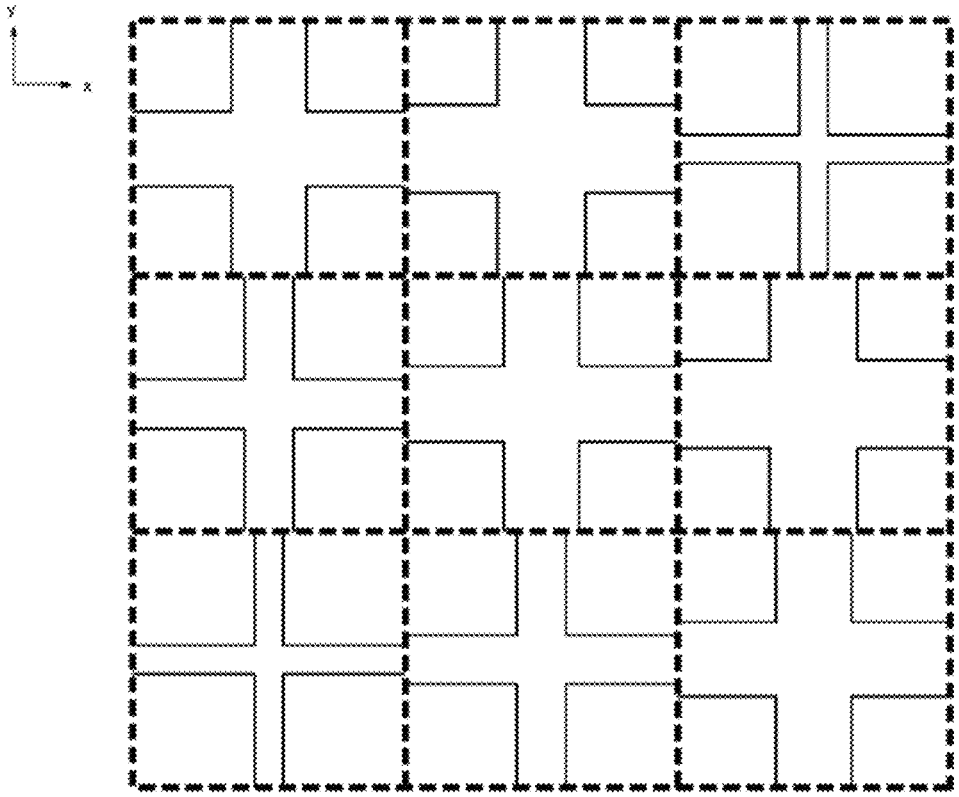
FIG. 5 is a diagram illustrating an example of a metal pattern of an admittance sheet.

An example of a metal pattern of an admittance sheet will be described. FIG. 5 illustrates an example of a metal pattern of an admittance sheet. As illustrated, a metal pattern of a single-layer admittance sheet may include a plurality of plane unit cells. Nine plane unit cells are illustrated in FIG. 5. The plane unit cell may be considered as a combination of an inductance L extending in an x-axis direction and an inductance L extending in a y-axis direction. Line widths and the like of metals constituting the respective plurality of plane unit cells are different from one another. By thus forming a plane unit cell different for each admittance sheet location, an admittance different for each location can be achieved.

Figure 6:
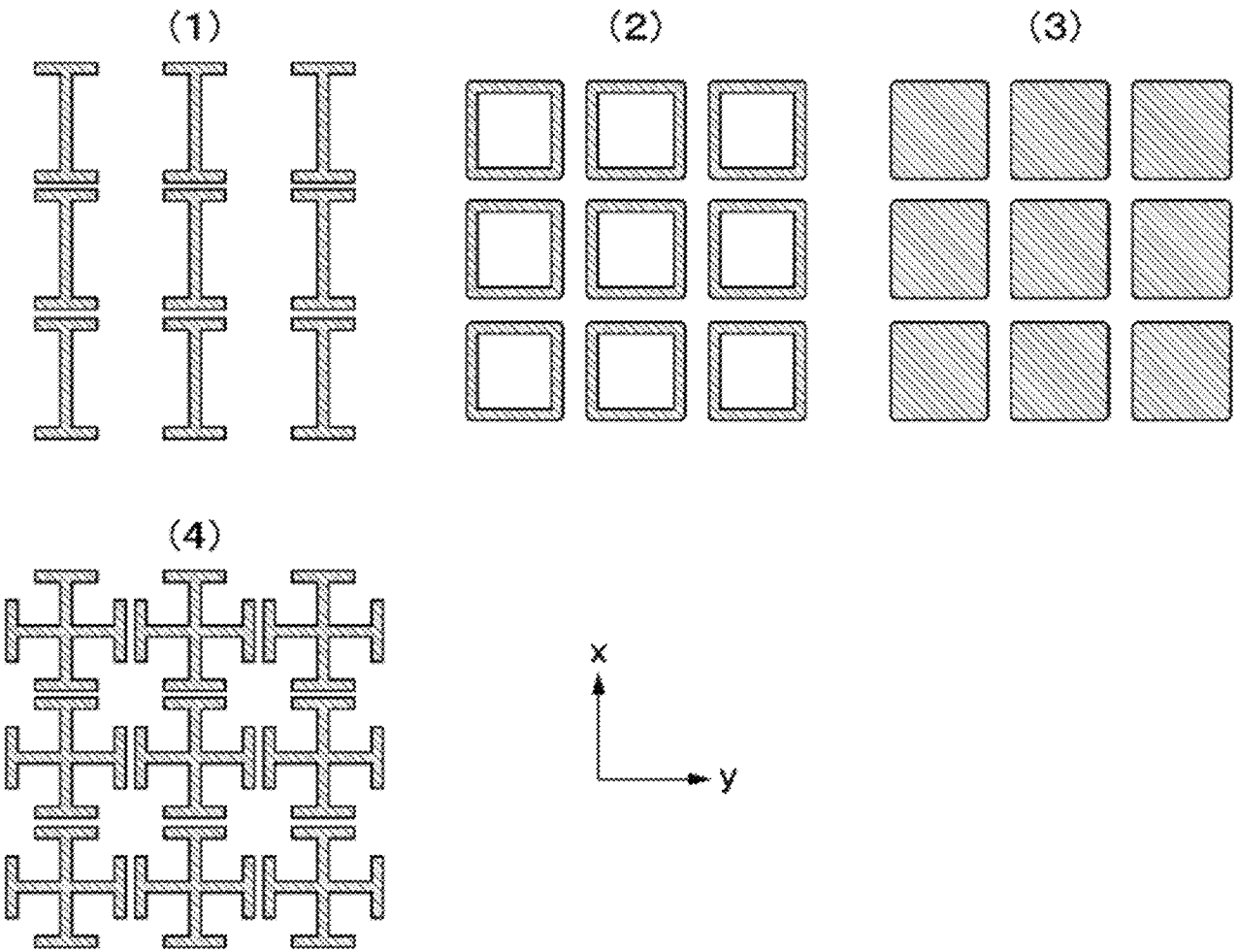
FIG. 6 is a diagram illustrating examples of a metal pattern providing a series resonance circuit.

Another example of a metal pattern of an admittance sheet will be described. In order to control an admittance over a wide range from a capacitance to an inductance, use of a resonance circuit is considered; and examples of a metal pattern providing a series resonance circuit are illustrated in FIG. 6. A metal pattern illustrated in FIG. 6(1) is configured by arranging a plurality of linear metals (plane unit cells) extending in an x-axis direction. A line width of each of two ends of the linear metal is wider than the other part, and a capacitance is formed between plane unit cells adjoining in the x-axis direction. Note that both ends do not necessarily need to be widened and may have the same width as a linear part or may be narrower than the linear part as long as a required capacitance between adjoining plane unit cells is secured.

A metal pattern in FIG. 6(2) is configured by arranging a plurality of quadrangular ring-shaped metals (plane unit cells) with sides extending in an x-axis direction and a y-axis direction. A metal pattern in FIG. 6(3) is configured by arranging a plurality of quadrangular insular metals (plane unit cells) with sides extending in the x-axis direction and the y-axis direction. A metal pattern in FIG. 6(4) is configured by arranging a plurality of cross-shaped metals (plane unit cells) including a linear metal extending in the x-axis direction and a linear metal extending in the y-axis direction.

Figure 7:
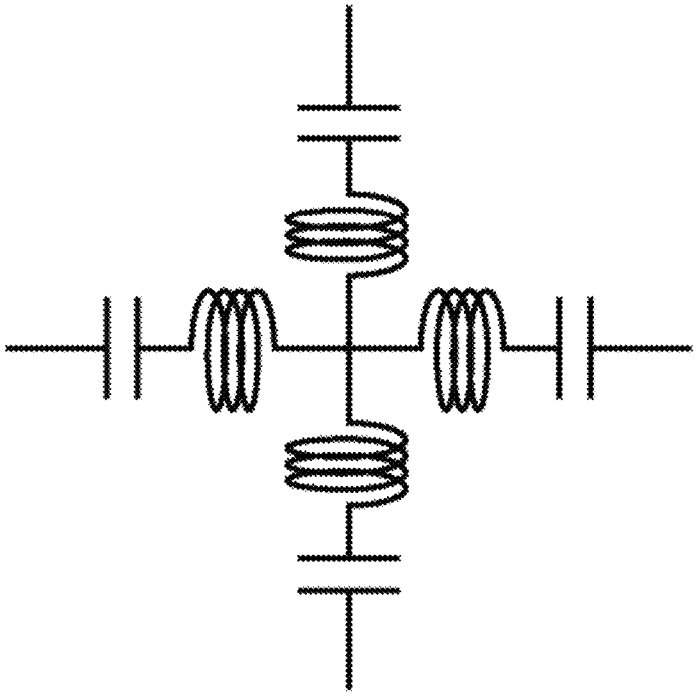
FIG. 7 is a diagram illustrating an equivalent circuit of the metal patterns in FIGS. 6(2) to (4).

For example, the x-axis indicates a direction of an electric field E and the y-axis indicates a direction perpendicular to the electric field E, in FIG. 6. Note that the metal patterns in FIGS. 6(2) to (4) are configured to act similarly also in a case where the electric field E has any direction in the xy-plane in the diagram. A two-dimensional equivalent circuit of each of the metal patterns in FIGS. 6(2) to (4) is illustrated in FIG. 7.

Figure 8:
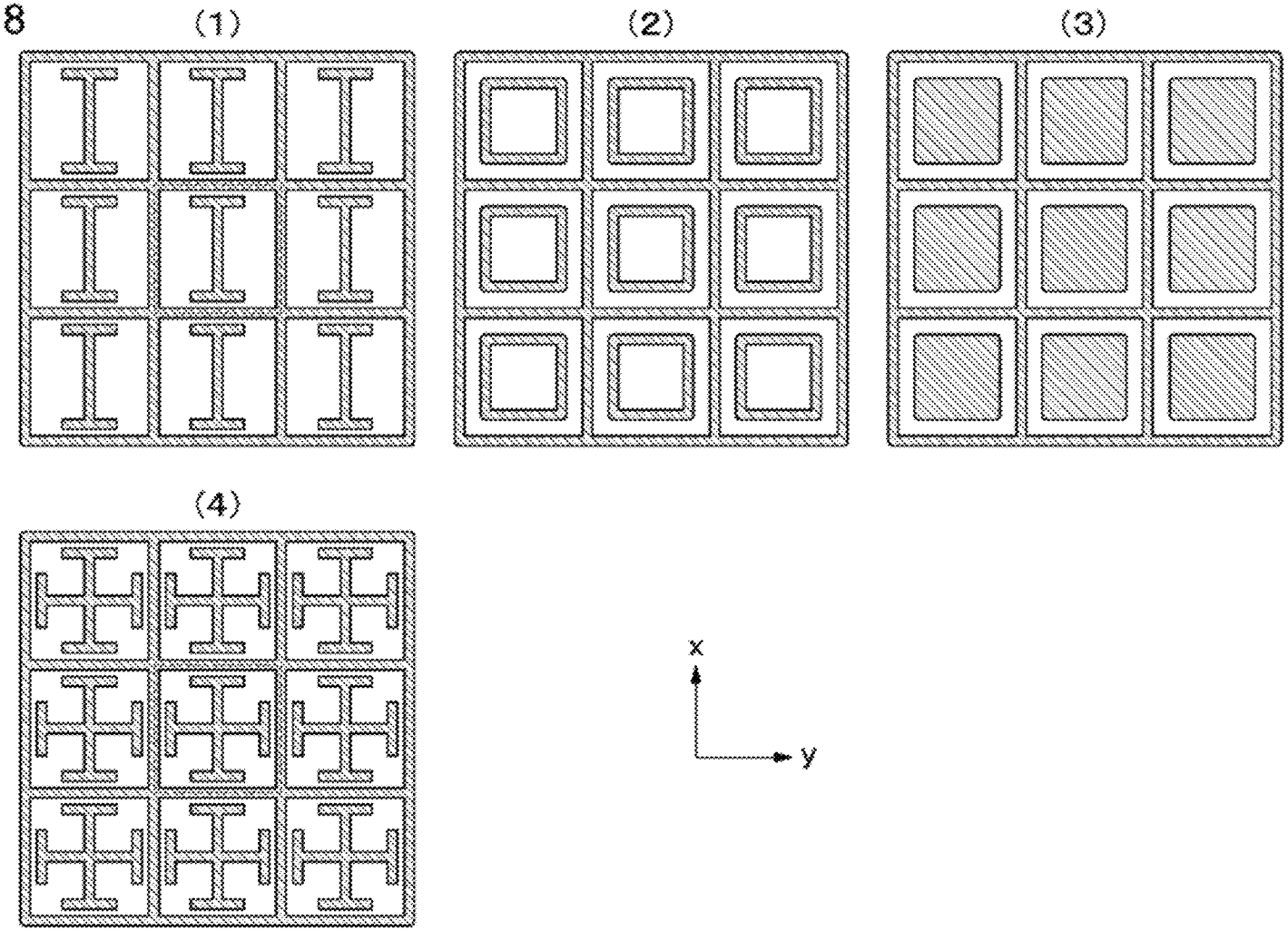
FIG. 8 is a diagram illustrating examples of a metal pattern providing a parallel resonance circuit.

Other examples of a metal pattern of an admittance sheet will be described. FIG. 8 illustrates examples of a metal pattern providing a parallel resonance circuit. A metal pattern in FIG. 8(1) includes plane unit cells each of which encloses each of a plurality of linear metals in the metal pattern illustrated in FIG. 6(1) with a quadrangular ring-shaped metal having sides extending in an x-axis direction and a y-axis direction. A metal pattern in FIG. 8(2) includes plane unit cells each of which encloses each of a plurality of quadrangular ring-shaped metals in the metal pattern illustrated in FIG. 6(2) with a quadrangular ring-shaped metal having sides extending in the x-axis direction and the y-axis direction. A metal pattern in FIG. 8(3) includes plane unit cells each of which encloses each of a plurality of quadrangular insular metals in the metal pattern illustrated in FIG. 6(3) with a quadrangular ring-shaped metal having sides extending in the x-axis direction and the y-axis direction. A metal pattern in FIG. 8(4) includes plane unit cells each of which encloses each of a plurality of cross-shaped metals in the metal pattern illustrated in FIG. 6(4) with a quadrangular ring-shaped metal having sides extending in the x-axis direction and the y-axis direction. In FIGS. 8(1) to (4), each of a plurality of ring-shaped metals enclosing the metals illustrated in FIGS. 6(1) to (4) shares one side with an adjoining ring-shaped metal.

Figure 9:
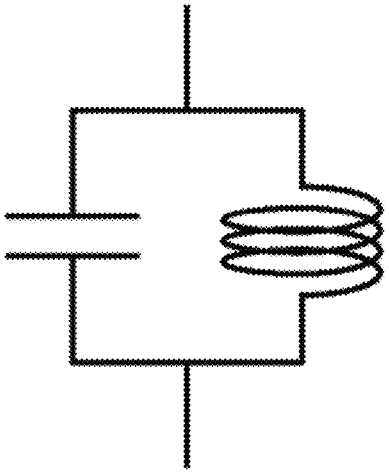
FIG. 9 is a diagram illustrating an equivalent circuit of the plane unit cells illustrated in FIGS. 8(1) to (4).

Each of the metal patterns illustrated in FIGS. 8(1) to (4) acts as a parallel resonance circuit with "an inductance L formed by a ring-shaped metal" and "a series resonator part in which a capacitance C formed by the ring-shaped metal adjoining a metal pattern inside the ring-shaped metal, an inductance L formed by the metal pattern inside the ring-shaped metal, and a capacitance C formed by the ring-shaped metal adjoining the metal pattern inside the ring-shaped metal are connected in series in this order in a longitudinal direction in the diagram." The series resonator part in which C, L, and C are connected in series operates as a capacitor up to a resonance frequency of the series resonator. Consequently, every plane unit cell in FIGS. 8(1) to (4) arrives at an equivalent circuit illustrated in FIG. 9. In other words, every plane unit cell in FIGS. 8(1) to (4) provides the equivalent circuit illustrated in FIG. 9, that is, a parallel resonance circuit.

Figure 10:
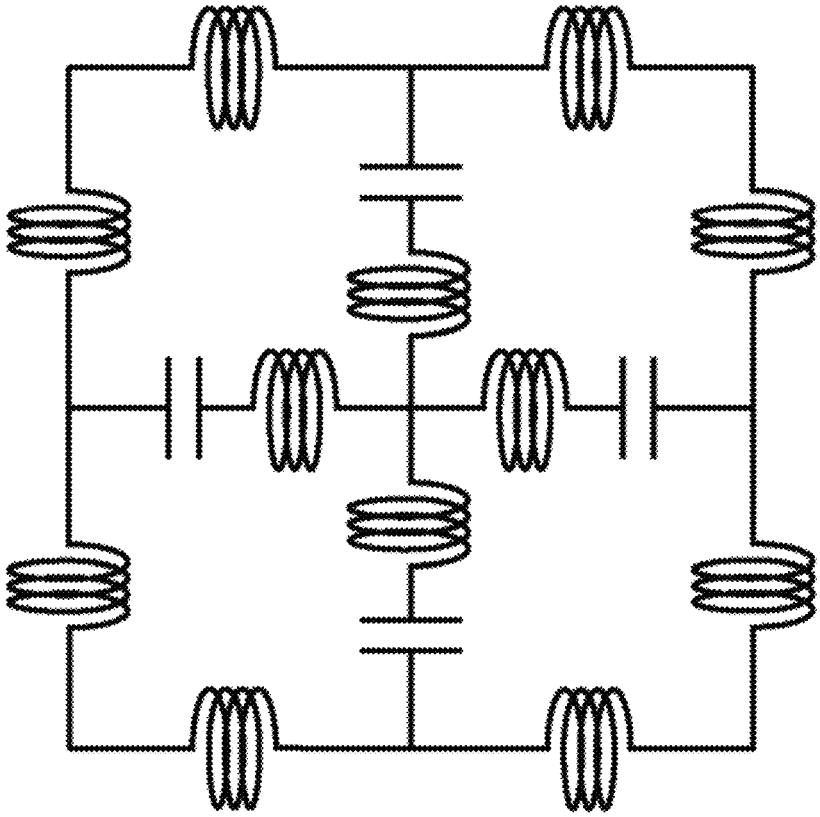
FIG. 10 is a diagram illustrating an equivalent circuit of the metal patterns illustrated in FIGS. 8(1) to (4).

For example, the x-axis indicates a direction of an electric field E, and the y-axis indicates a direction perpendicular to the electric field E in FIG. 8. Note that the metal patterns in FIGS. 8(2) to (4) are configured to act similarly also in a case where the electric field E has any direction in the xy-plane in the diagram. A two-dimensional equivalent circuit of each of the metal patterns in FIGS. 8(2) to (4) is illustrated in FIG. 10.

Note that, while each of the metal patterns illustrated in FIG. 6 and FIG. 8 is configured by arranging a plurality of the same plane unit cells, lengths of the metal lines, thicknesses of the metal lines, intervals between the metal lines, areas of the metal parts, and the like in the plurality of plane unit cells may be different from one another.

Figure 11:
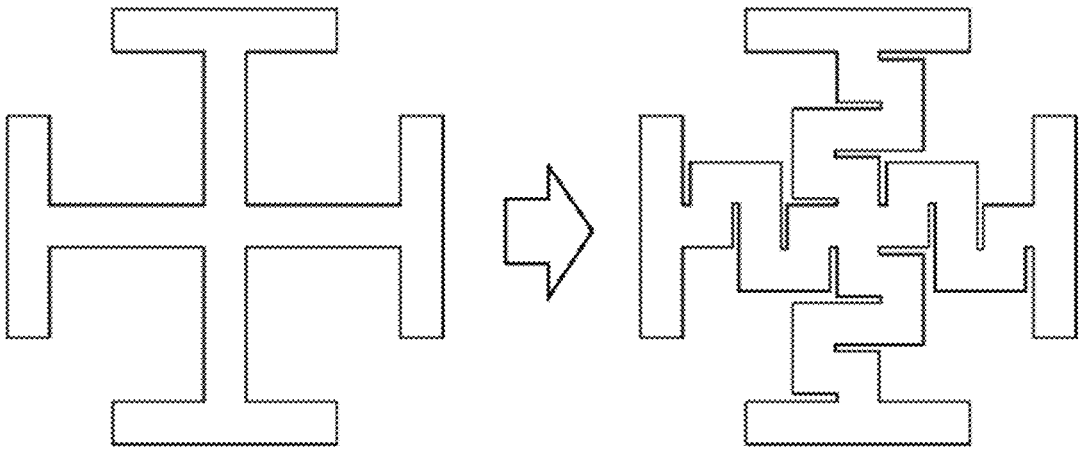
FIG. 11 is a diagram for illustrating an example of a metal pattern.
Figure 12:
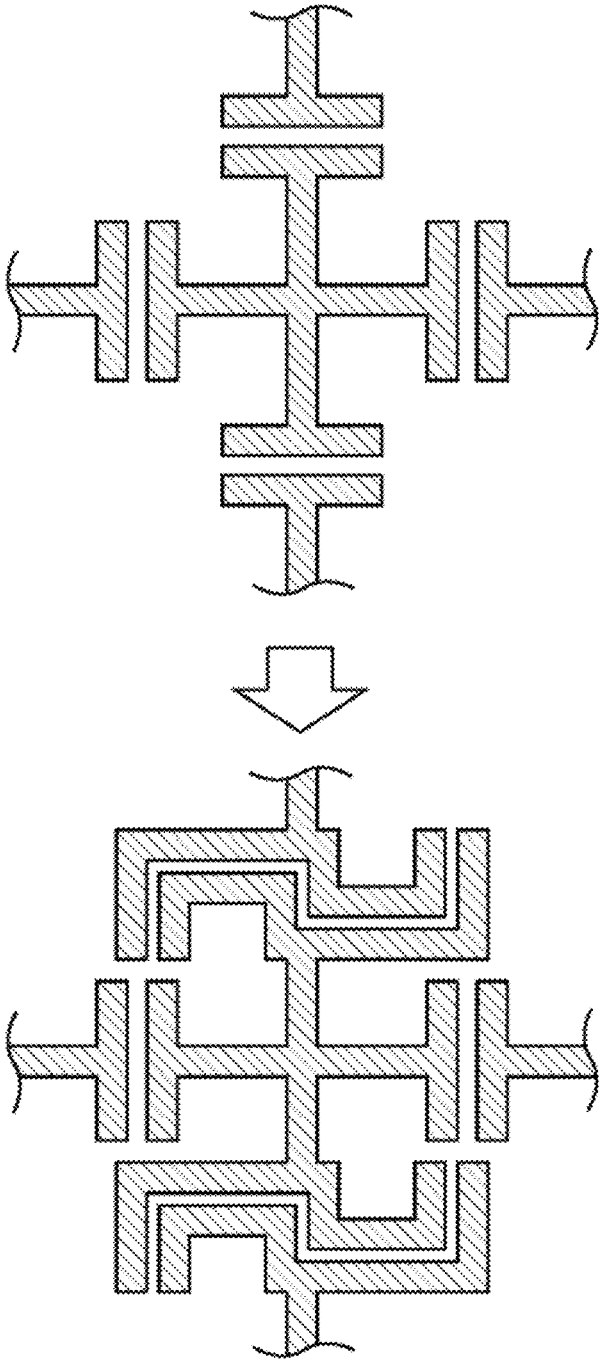
FIG. 12 is a diagram for illustrating an example of a metal pattern.

When designing a metal pattern, C can be increased by forming a capacitor part as, for example, an interdigital capacitor. Further, L can be increased by forming an inductor part as, for example, a meander inductor or a spiral inductor. FIG. 11 illustrates a modified example of the cross-shaped metal in FIG. 6(4) and FIG. 8(4). FIG. 12 illustrates a modified example of the cross-shaped metal in FIG. 6(4). In FIG. 11, an effect of increasing L can be expected by changing a linear metal pattern to a meander shape. In FIG. 12, an effect of increasing C can be expected by changing opposing metal patterns to interdigital shapes.

Next, examples of a lamination method of an admittance sheet having the metal pattern as described above will be described. The phase control plate according to the present example embodiment is configured by overlapping n layers ($n \geq 4$) of admittance sheets each of which has the aforementioned metal pattern.

Figure 13:
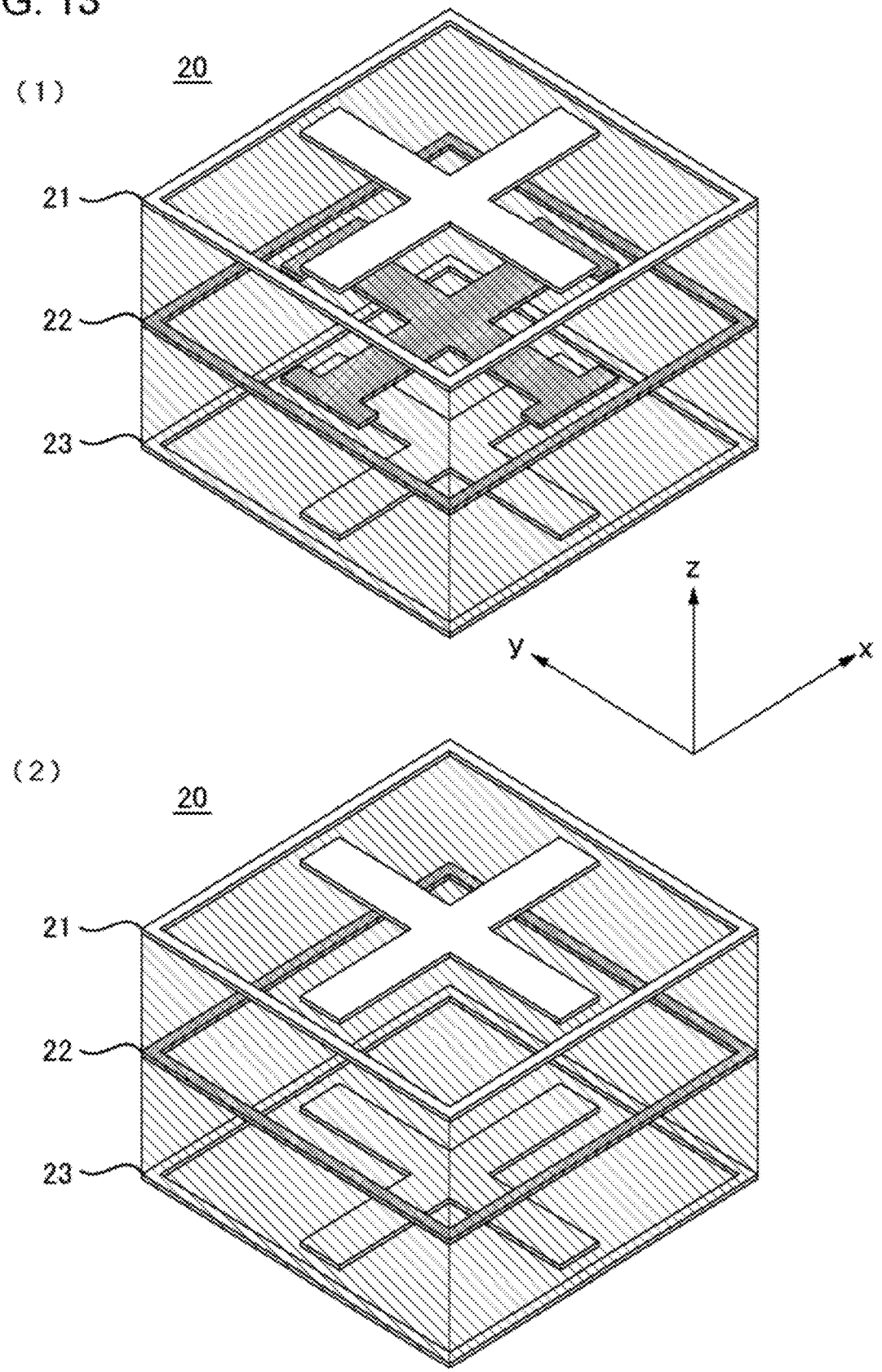
FIG. 13 is a diagram for illustrating an example of a laminated body in which plane unit cells are laminated.
Figure 14:
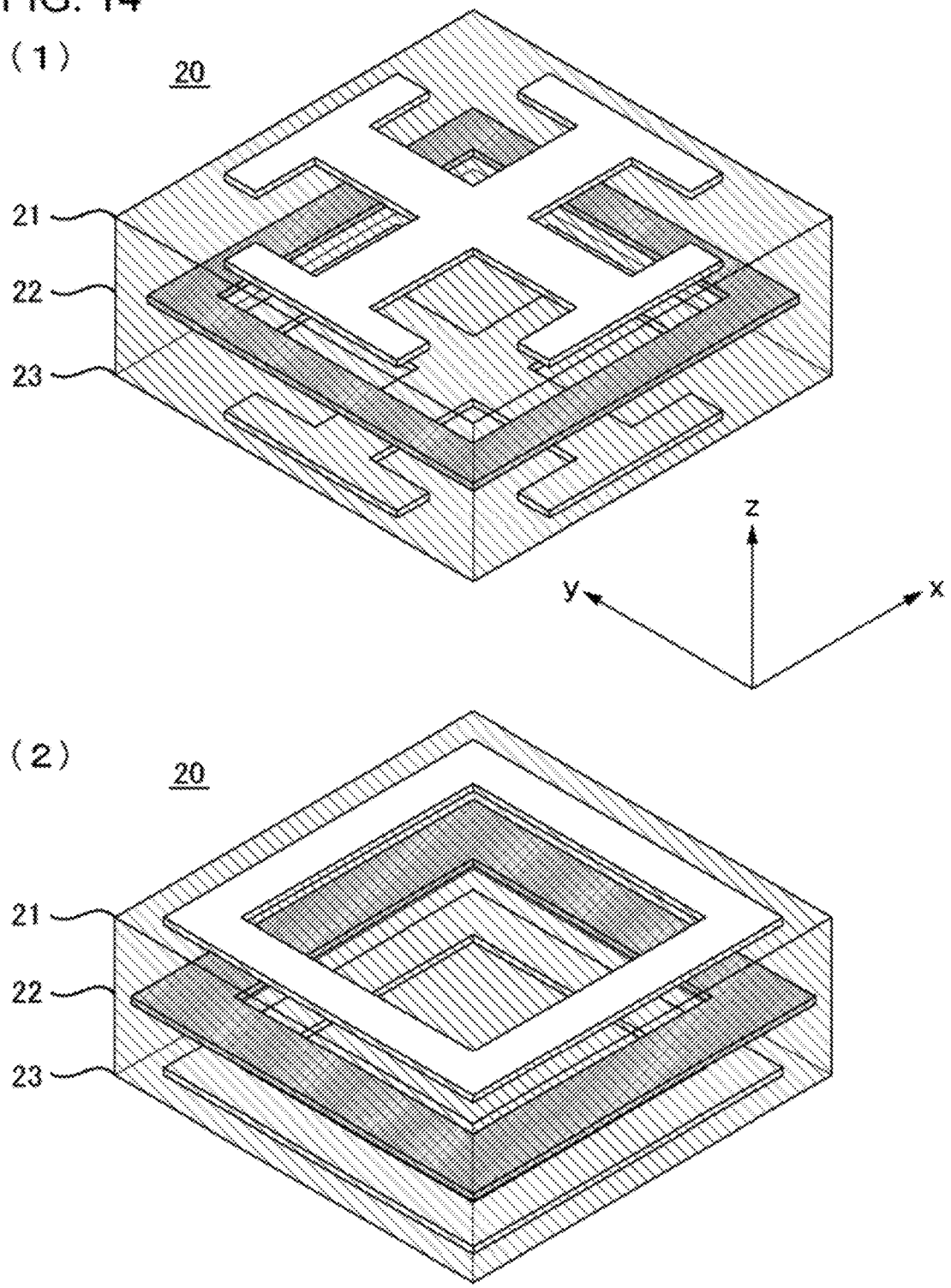
FIG. 14 is a diagram for illustrating an example of a laminated body in which plane unit cells are laminated.

FIG. 13 and FIG. 14 are examples of laminating three layers of admittance sheets, and only one plane unit cell is extracted and illustrated from each layer. According to the present example embodiment, for example, by repeatedly laminating laminated bodies of three layers of admittance sheets as illustrated, a phase control plate including six layers or more of admittance sheets can be provided. As illustrated, a plurality of admittance sheets are laminated in such a way that plane unit cells overlap one another. It is preferable that plane unit cells of the admittance sheets completely overlap one another as illustrated, but a discrepancy may occur.

FIG. 13 illustrates examples of a parallel resonator type laminated body 20. A laminated body 20 in FIG. 13(1) is configured with a first plane unit cell 21, a second plane unit cell 22, and a third plane unit cell 23. The first plane unit cell 21 includes an outer peripheral metal enclosing an outer periphery and a cross-shaped inner metal positioned inside the outer peripheral metal. The outer peripheral metal is isolated from the inner metal. The second plane unit cell 22 includes an outer peripheral metal enclosing an outer periphery and a cross-shaped inner metal positioned inside the outer peripheral metal. A line width at each end of two linear metals forming the cross shape is widened. Further, the outer peripheral metal is isolated from the inner metal. The third plane unit cell 23 includes an outer peripheral metal enclosing an outer periphery and a cross-shaped inner metal positioned inside the outer peripheral metal. The outer peripheral metal is isolated from the inner metal. The first plane unit cell 21 to the third plane unit cell 23 are isolated from one another. A part where a metal pattern does not exist is filled with, for example, a dielectric.

A laminated body 20 in FIG. 13(2) is also configured with a first plane unit cell 21, a second plane unit cell 22, and a third plane unit cell 23. The first plane unit cell 21 includes an outer peripheral metal enclosing an outer periphery and a cross-shaped inner metal positioned inside the outer peripheral metal. The outer peripheral metal is isolated from the inner metal. The second plane unit cell 22 includes an outer peripheral metal enclosing an outer periphery. The third plane unit cell 23 includes an outer peripheral metal enclosing an outer periphery and a cross-shaped inner metal positioned inside the outer peripheral metal. The outer peripheral metal is isolated from the inner metal. The first plane unit cell 21 to the third plane unit cell 23 are isolated from one another. A part where a metal pattern does not exist is filled with, for example, a dielectric.

FIG. 14 illustrates examples of a series resonator type laminated body 20. A laminated body 20 in FIG. 14(1) is configured with a first plane unit cell 21, a second plane unit cell 22, and a third plane unit cell 23. The first plane unit cell 21 includes a cross-shaped metal, and a line width at each end of two linear metals forming the cross shape is widened. The second plane unit cell 22 includes a quadrangular ring-shaped metal. The third plane unit cell 23 includes a cross-shaped metal, and a line width at each end of two linear metals forming the cross shape is widened. The first plane unit cell 21 to the third plane unit cell 23 are isolated from one another. A part where a metal pattern does not exist is filled with, for example, a dielectric.

A laminated body 20 in FIG. 14(2) is also configured with a first plane unit cell 21, a second plane unit cell 22, and a third plane unit cell 23. Each of the first plane unit cell 21, the second plane unit cell 22, and the third plane unit cell 23 includes a quadrangular ring-shaped metal. The first plane unit cell 21 to the third plane unit cell 23 are isolated from one another. A part where a metal pattern does not exist is filled with, for example, a dielectric.

Figure 15:
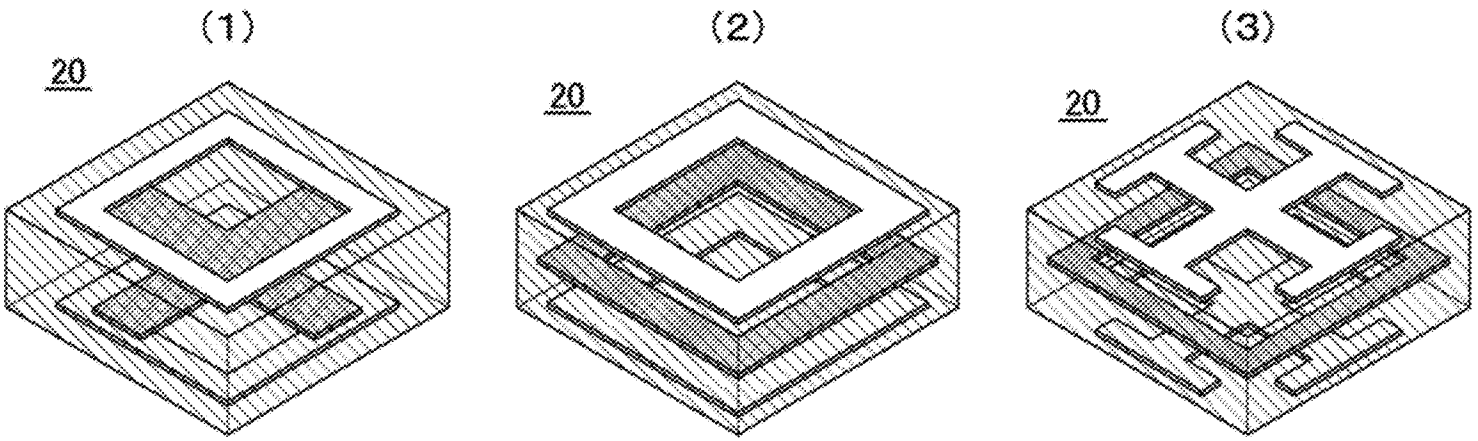
FIG. 15 is a diagram for illustrating an example of a laminated body in which plane unit cells are laminated.

FIG. 15 illustrates variations of a laminated body 20, each variation being configured with three layers of admittance sheets and being based on a series resonator type and an inductance type. According to the present example embodiment, for example, by repeatedly laminating the laminated bodies 20, a phase control plate configured with six layers or more of admittance sheets can be provided.

Laminated bodies 20 in FIG. 15 are numbered from 1 to 3. In 1, a quadrangular ring-shaped metal pattern, a cross-shaped metal pattern, and a quadrangular ring-shaped metal pattern are laminated in this order. In 2, three quadrangular ring-shaped metal patterns are laminated. In 3, a metal pattern with a cross shape each end of which having a widened line width, a quadrangular ring-shaped metal pattern, and a metal pattern with a cross shape each end of which having a widened line width are laminated in this order.

Figure 16:
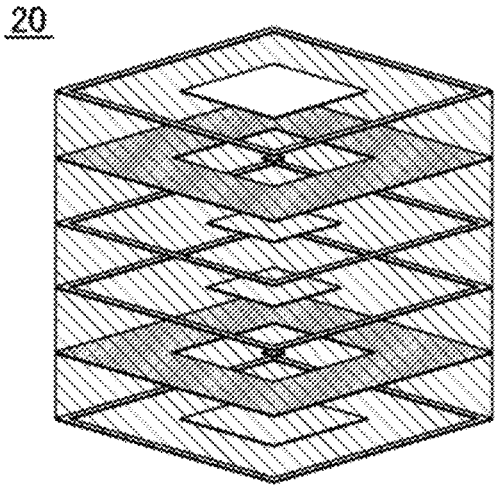
FIG. 16 is a diagram for illustrating an example of a laminated body in which plane unit cells are laminated.

Next, FIG. 16 illustrates an example of a laminated body 20 being configured with six layers of admittance sheets and being based on a parallel resonator type. In the illustrated laminated body 20, six metal patterns each of which includes a quadrangular inner metal and a quadrangular ring-shaped metal enclosing an outer periphery of the inner metal are laminated.

Note that n layers ($n \geq 4$) of admittance sheets are laminated in such a way as to satisfy the following conditions, First, an admittance of a first plane unit cell included in an admittance sheet in a layer a ($1 \leq a \leq n$) out of then layers ($n \geq 4$) of admittance sheets and an admittance of a second plane unit cell being included in an admittance sheet in a layer b ($1 \leq b \leq n$ and $b \neq a$) and overlapping the first plane unit cell are different from each other. In other words, plane unit cells admittances of which are different from each other exist in a three-dimensional unit cell configured with a plurality of plane unit cells overlapping one another.

Further, the phase control plate according to the present example embodiment includes a plurality of three-dimensional unit cells each of which is configured with a plurality of plane unit cells overlapping one another. A three-dimensional unit cell is configured by laminating n layers ($n \geq 4$) of plane unit cells. Then, a condition "when admittances of a plurality of plane unit cells included in the same three-dimensional unit cell are compared, the difference between an admittance of a c-th layer ($1 \leq c \leq n$) and an admittance of an ($n-c+1$)-th layer is less than a reference value" is satisfied in at least one of the plurality of three-dimensional unit cells included in the phase control plate. In other words, admittances of a plurality of plane unit cells included in the same three-dimensional unit cell are symmetric with respect to the plane unit cell in the middle.

In this case, a metal pattern of a plane unit cell in the c-th layer ($1 \leq c \leq n$) may be the same as a metal pattern of a plane unit cell in the ($n-c+1$)-th layer in at least one three-dimensional unit cell. The same metal pattern means that shapes, line widths, line lengths, and the like of metals are equivalent and the difference in admittance is less than the reference value.

Such a symmetric structure can simplify design while achieving desired advantageous effects.

Figure 17:
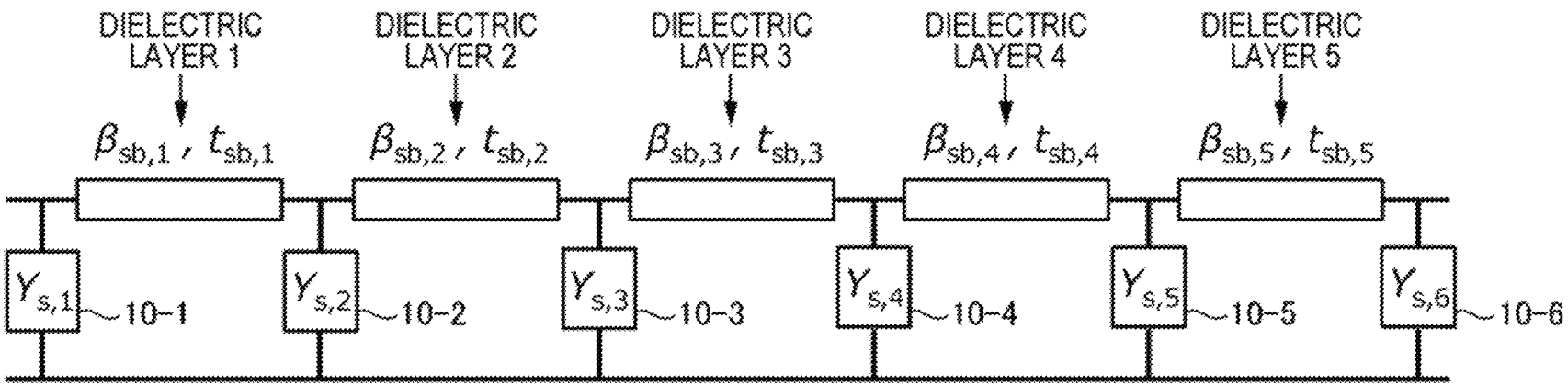
FIG. 17 is a diagram illustrating an example of an equivalent circuit diagram of a phase control plate.
Figure 18:
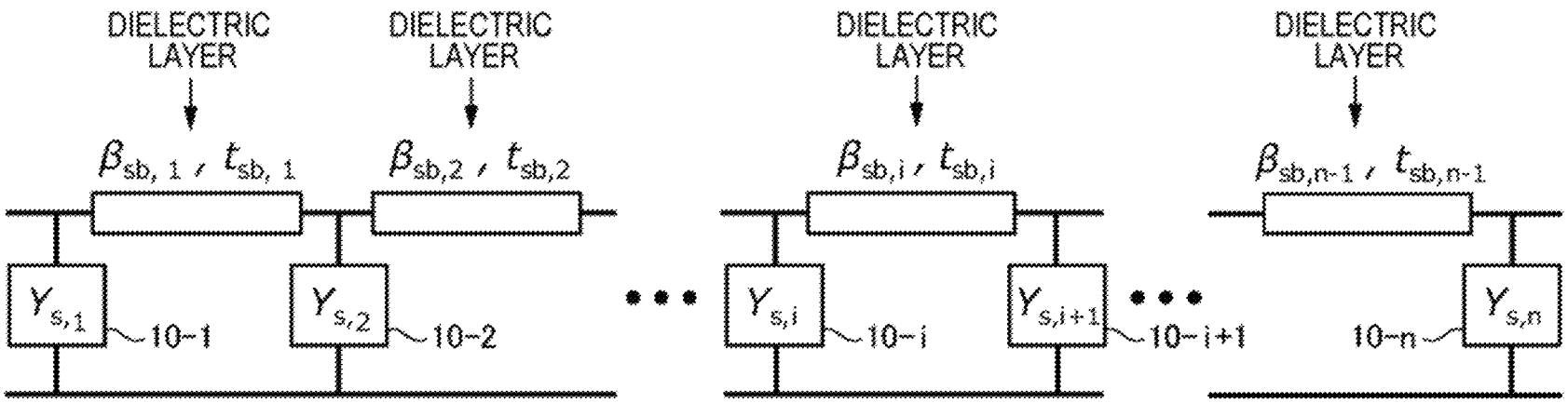
FIG. 18 is a diagram illustrating an example of an equivalent circuit diagram of a phase control plate.

Further, an equivalent circuit diagram of a phase control plate in which six layers of admittance sheets and five layers of dielectric layers are laminated is illustrated in FIG. 17. Note that an equivalent circuit diagram of a phase control plate in which n layers of admittance sheets and ($n-1$) layers of dielectric layers are laminated is illustrated in FIG. 18.

Y denotes an admittance, $\beta$ denotes a phase constant in a dielectric layer, and t denotes a thickness of the dielectric layer. An ABCD matrix of each admittance sheet and each dielectric layer can be written down from the equivalent circuit diagram, and a Z matrix ($Z_{11}$, $Z_{12}$, $Z_{21}$, $Z_{22}$) of the phase control plate can also be written down from the ABCD matrices.

A scattering coefficient formula G expressed by Equation (3) is described by use of the Z matrix and normalized impedances ($Z_S$, $Z_L$) of the phase control plate.

[Math. 3]

SCATTERING COEFFICIENT FORMULA (3)

$$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1}$$

$Z_S$ denotes a normalized impedance determined by an incidence angle of an electromagnetic wave with respect to the phase control plate and a space impedance of a space where the phase control plate is positioned (for example, an impedance of air). $Z_L$ denotes a normalized impedance determined by an emission angle of an electromagnetic wave with respect to the phase control plate and the aforementioned space impedance.

When an incident wave and an emitted wave are transverse electric (TE) waves, $Z_S$ and $Z_L$ are expressed as Equations (4) and (5).

[Math. 4]

$$Z_s = \eta_0 \frac{1}{\cos\theta_i} \quad (4)$$

[Math. 5]

$$Z_L = \eta_0 \frac{1}{\cos\theta_t} \quad (5)$$

Further, when an incident wave and an emitted wave are transverse magnetic (TM) waves, $Z_S$ and $Z_L$ are expressed as Equations (6) and (7).

[Math. 6]

$$Z_S = \eta_0 \cos_{\theta_i} \quad (6)$$

[Math. 7]

$$Z_L = \eta_0 \cos_{\theta_t} \quad (7)$$

Note that $\eta_0$ is a space impedance of a space where the phase control plate is positioned. Further, $\theta_i$ is an incidence angle of an electromagnetic wave with respect to the phase control plate. Further, $\theta_t$ is an emission angle of an electromagnetic wave with respect to the phase control plate.

According to the present example embodiment, admittances of n layers of admittance sheets are given in such a way that an off-diagonal element of the aforementioned scattering coefficient formula G is equal to or greater than 0.8. A structure satisfying the condition provides a high transmissivity and achieves desired advantageous effects.

Advantageous effects of the phase control plate according to the present example embodiment will be described. The entire structure of the phase control plate configured by laminating a plurality of admittance sheets approaches a resonance state when a predetermined condition is satisfied. Consequently, inconveniences such as a narrowed bandwidth in addition to increase in flowing current and increase in a loss occur. The present inventors have discovered that when a structure including three layers of admittance sheets and two layers of dielectric layers that are alternately laminated is configured to perform phase control over a wide range from 0 to 360 degrees, the aforementioned resonance state is likely to occur in a specific phase range.

The phase control plate according to the present example embodiment resolves the problem with a structure including six layers of admittance sheets and five layers of dielectric layers that are alternately laminated. Three layers of admittance sheets and two layers of dielectric layers in the laminated structure perform phase control for 0 to 180 degrees, and the other three layers of admittance sheets and the other two layers of dielectric layers perform phase control for 180 to 360 degrees. The inconvenience being occurrence of a resonance state is avoided by narrowing a phase range covered by the structure including three layers of admittance sheets and two layers of dielectric layers. Then, phase control over a wide range from 0 to 360 degrees is achieved by laminating structures each of which includes three layers of admittance sheets and two layers of dielectric layers.

Figure 23:
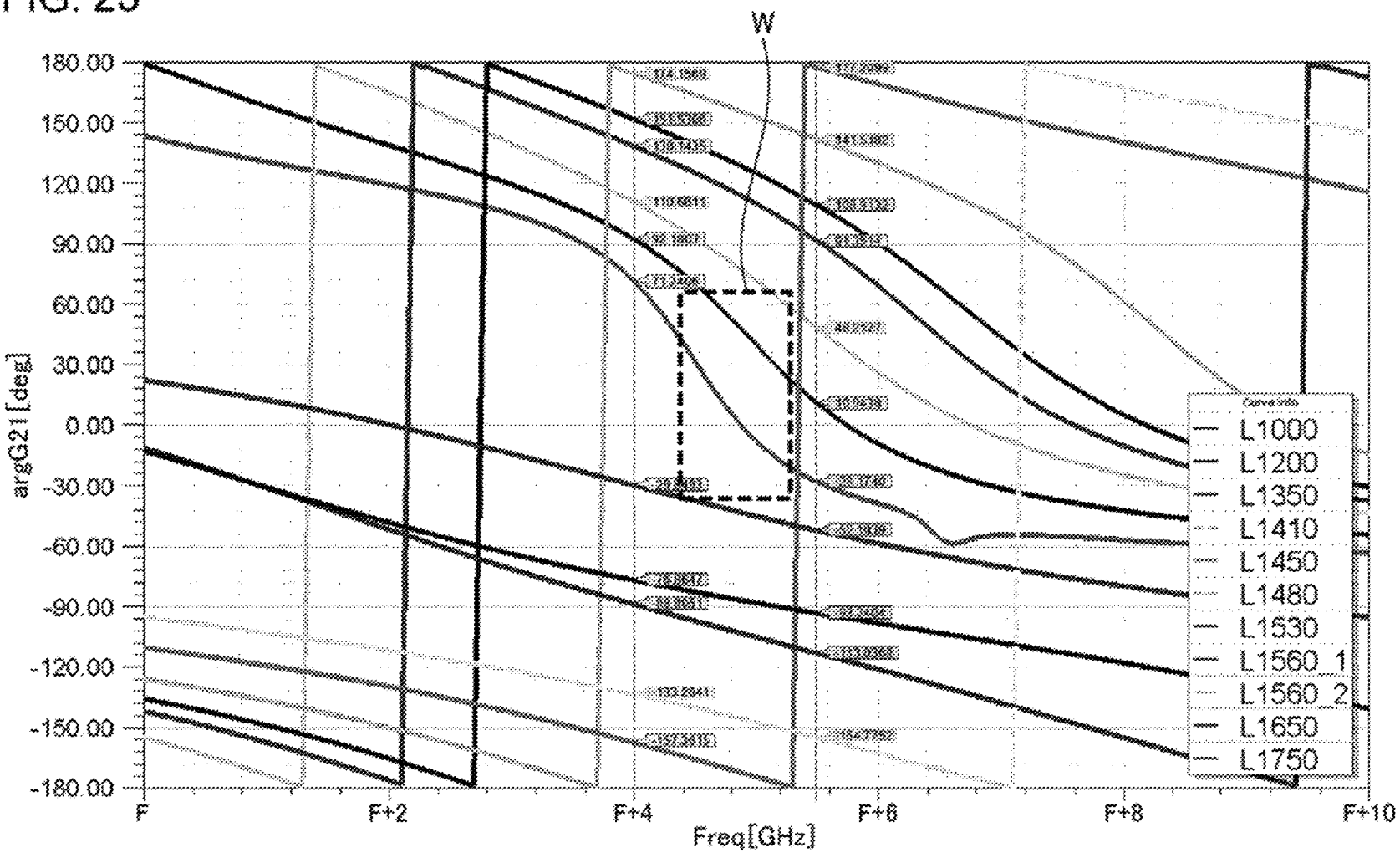
FIG. 23 is a diagram illustrating a simulation result of the three-layer structure.

The difference in characteristics between a three-layer structure and a six-layer structure are presented by use of FIG. 22 to FIG. 29. In a three-layer structure illustrated in FIG. 22 in which three layers of admittance sheets are laminated, data (a simulation result) of arg(G21) between the lower surface and the upper surface of the structure are illustrated in FIG. 23. The horizontal axis indicates a frequency (GHz) of a transmitted electromagnetic wave. Data in a frequency width of 10 GHz are illustrated in the diagram. A structural parameter (a sheet admittance of each plane) varies by line. Note that 360 degrees (from −180 degrees to 180 degrees) is covered in steps of about 45 degrees.

A steep frequency response exists in a part indicated by a frame W in FIG. 23. In other words, existence of a three-dimensional unit cell exhibiting a steep frequency response is confirmed.

Figure 24:
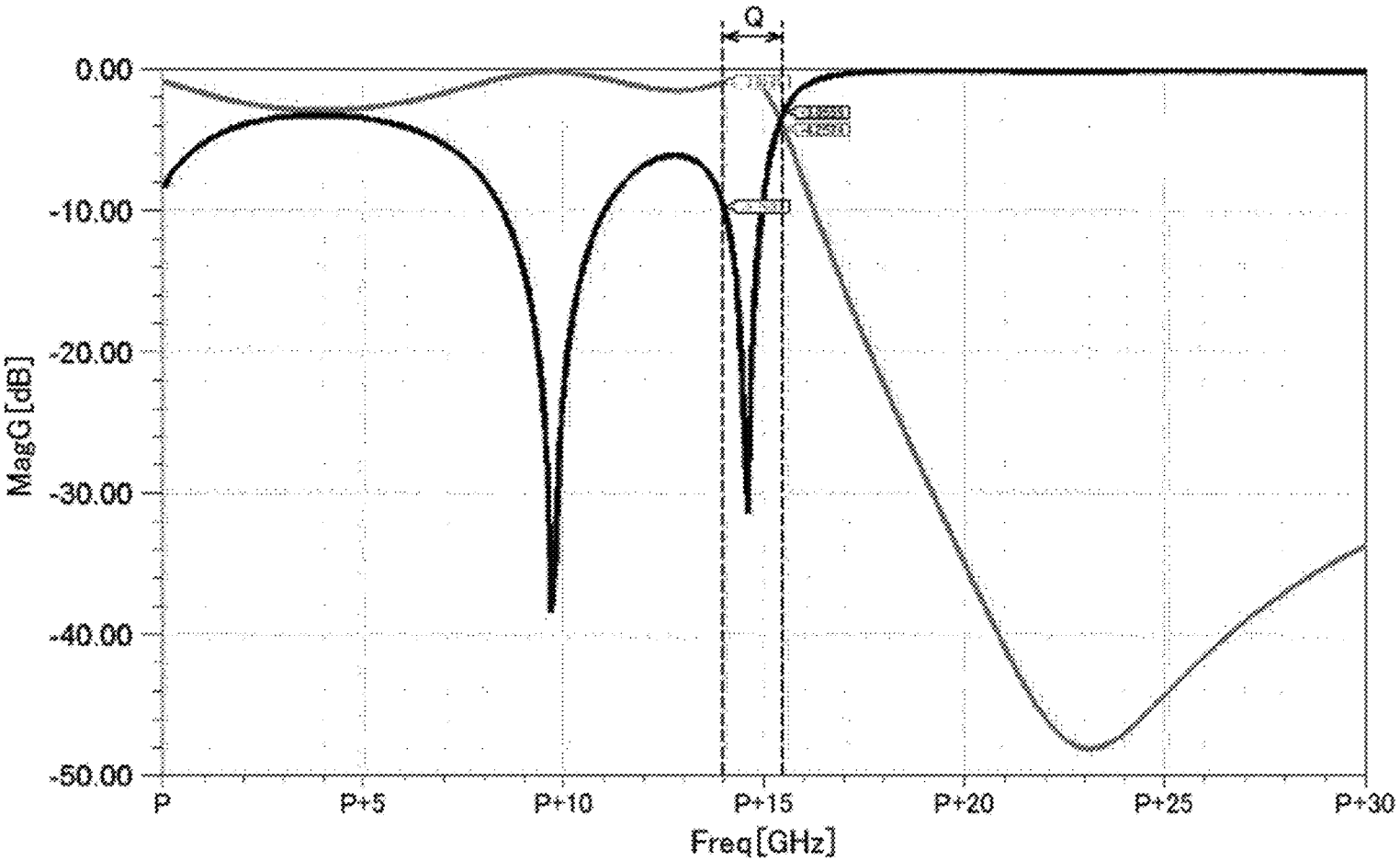
FIG. 24 is a diagram illustrating a simulation result of the three-layer structure.
Figure 25:
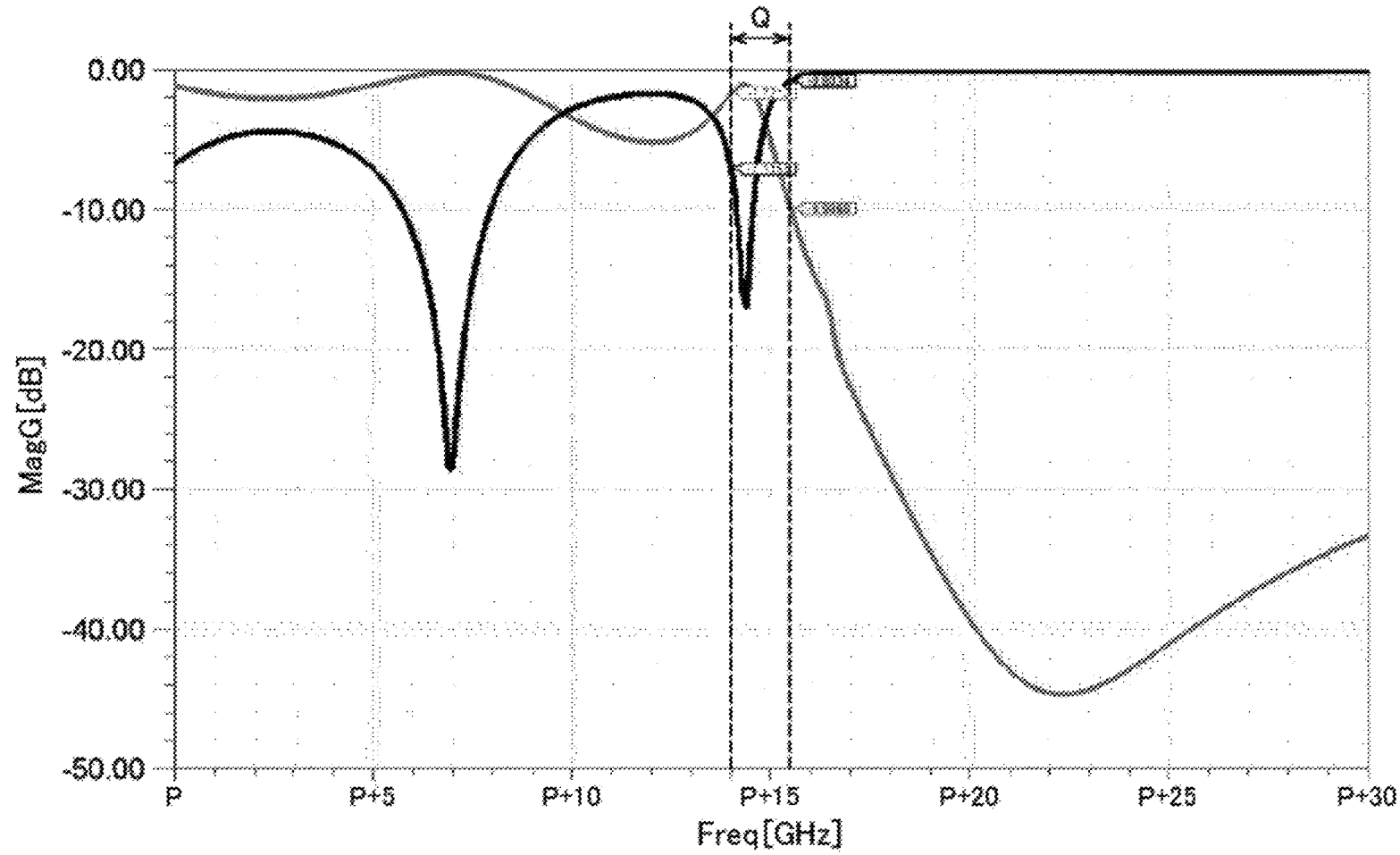
FIG. 25 is a diagram illustrating a simulation result of the three-layer structure.

Passing power characteristics [arg(G21) between the lower surface and the upper surface of a structure] of two three-dimensional unit cells exhibiting a steep frequency response are illustrated in FIG. 24 and FIG. 25. Each diagram tells that a bandwidth is remarkably narrow, and a practically required characteristic is not achieved. Further, while P represents an example of a required bandwidth in the diagram, it is observed that an impedance matching characteristic is degraded at the edge of a required bandwidth Q and passing efficiency is significantly reduced.

Figure 26:
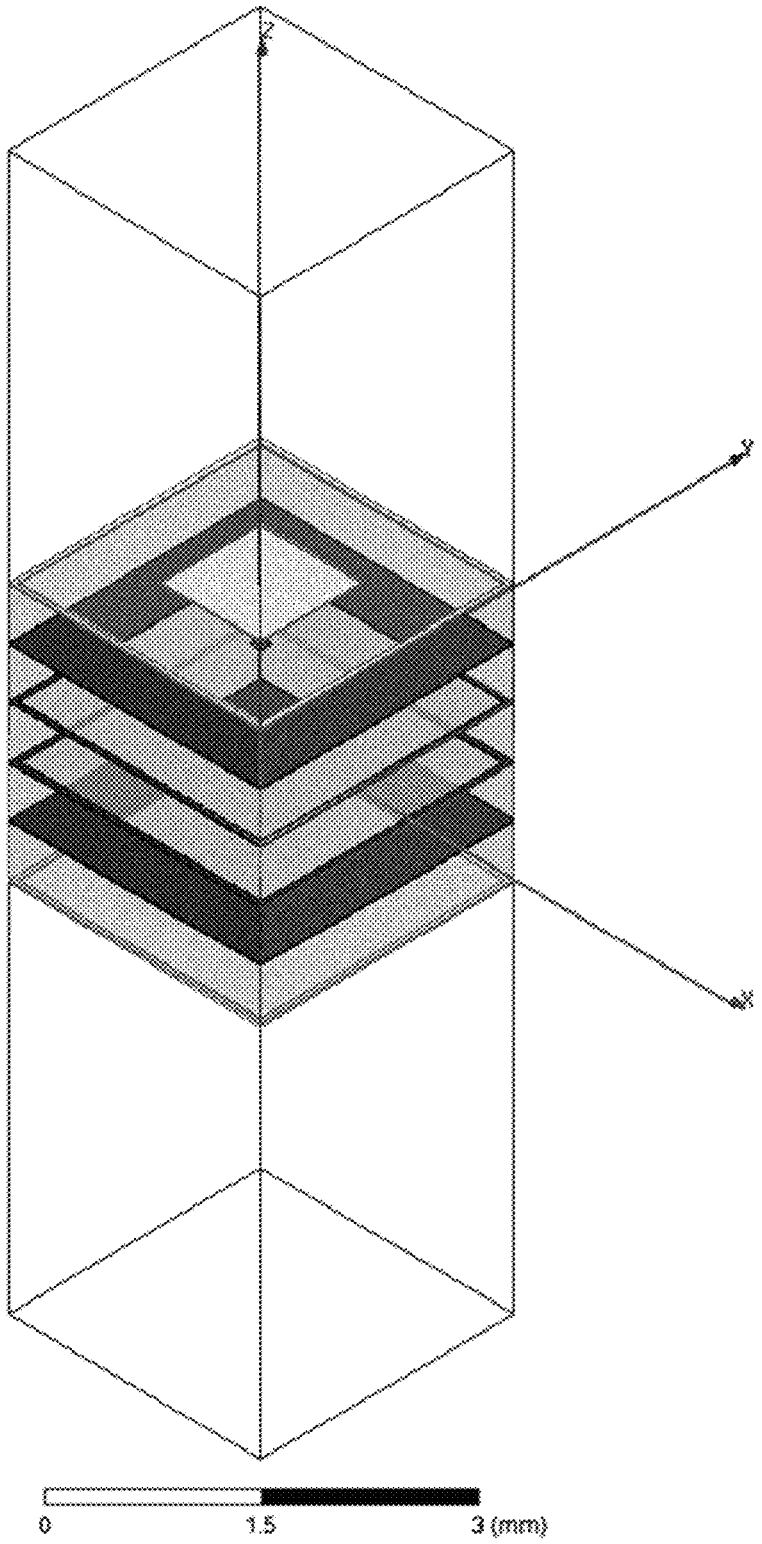
FIG. 26 is a diagram illustrating an example of a six-layer structure.
Figure 27:
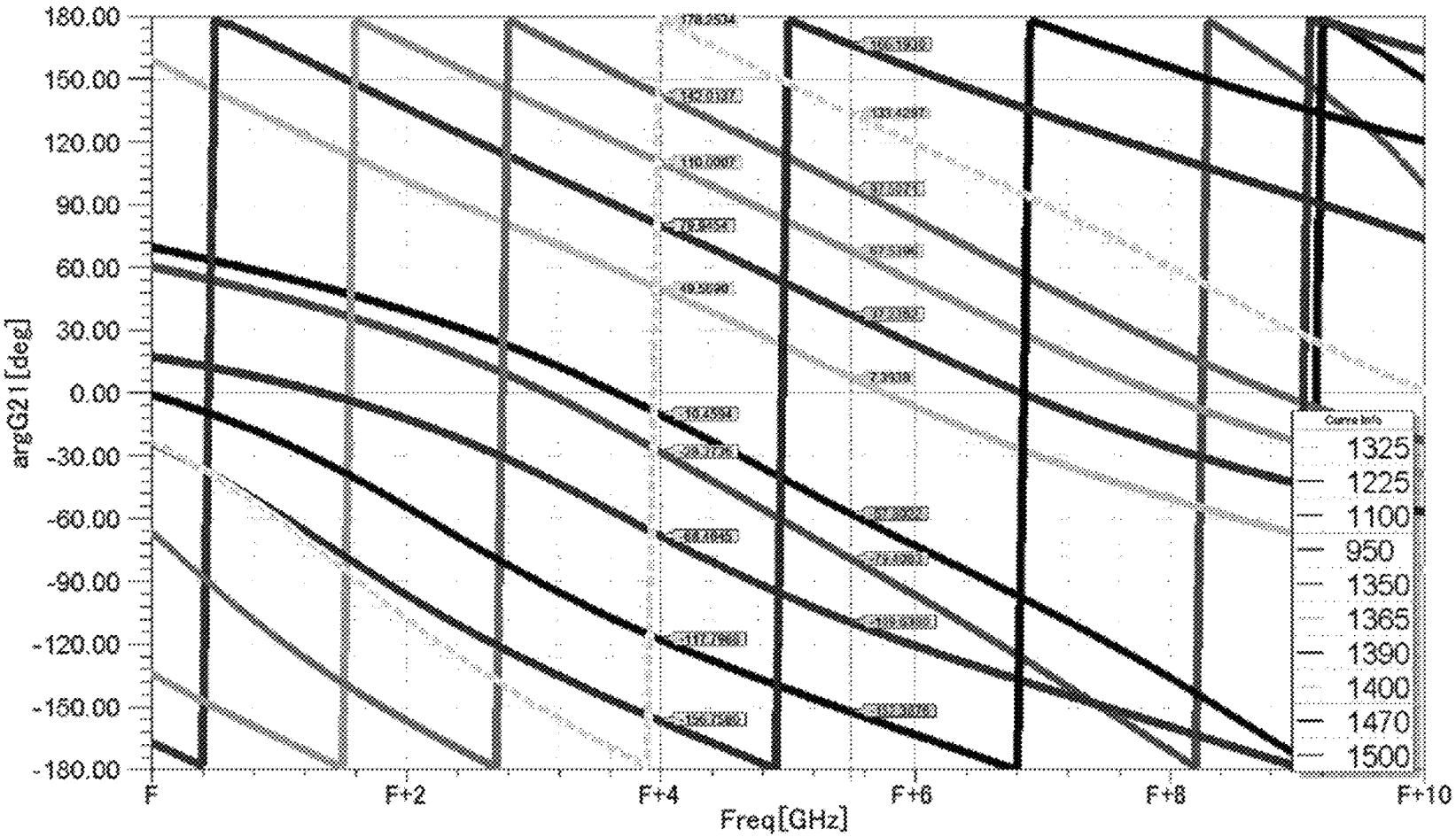
FIG. 27 is a diagram illustrating a simulation result of the six-layer structure.

Next, in a six-layer structure illustrated in FIG. 26 in which six layers of admittance sheets are laminated, data (a simulation result) of arg(G21) between the lower surface and the upper surface of the structure are illustrated in FIG. 27. The six-layer structure has a structure in which a three-layer structure covering 180 degrees (from −180 degrees to 0 degrees) in steps of about 45 degrees and a three-layer structure covering 180 degrees (from 0 degrees to 180 degrees) in steps of about 45 degrees are laminated. Unlike the case of the three-layer structure, no steep frequency response exists in FIG. 26. In other words, no three-dimensional unit cell exhibiting a steep frequency response exists.

Figure 28:
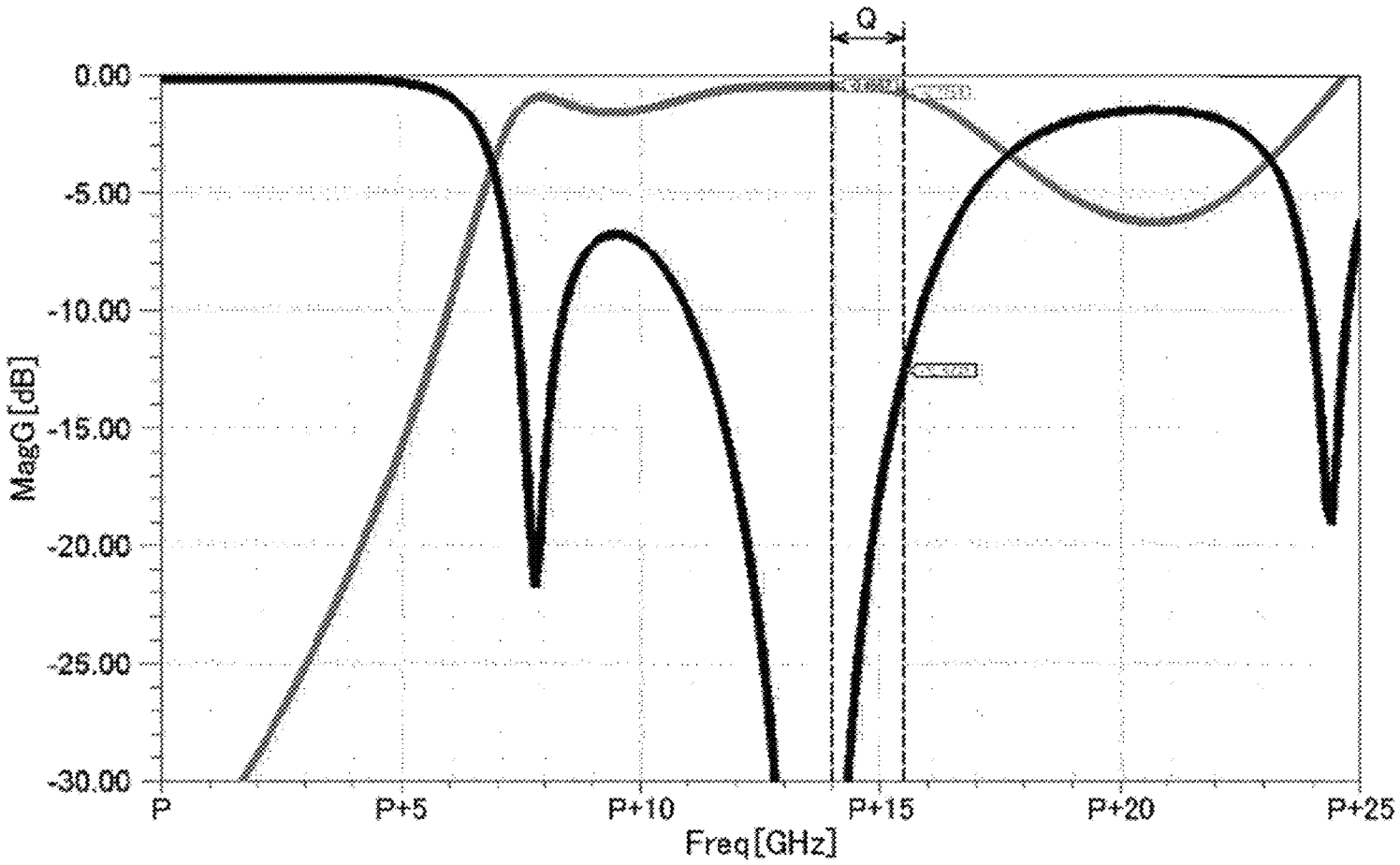
FIG. 28 is a diagram illustrating a simulation result of the six-layer structure.
Figure 29:
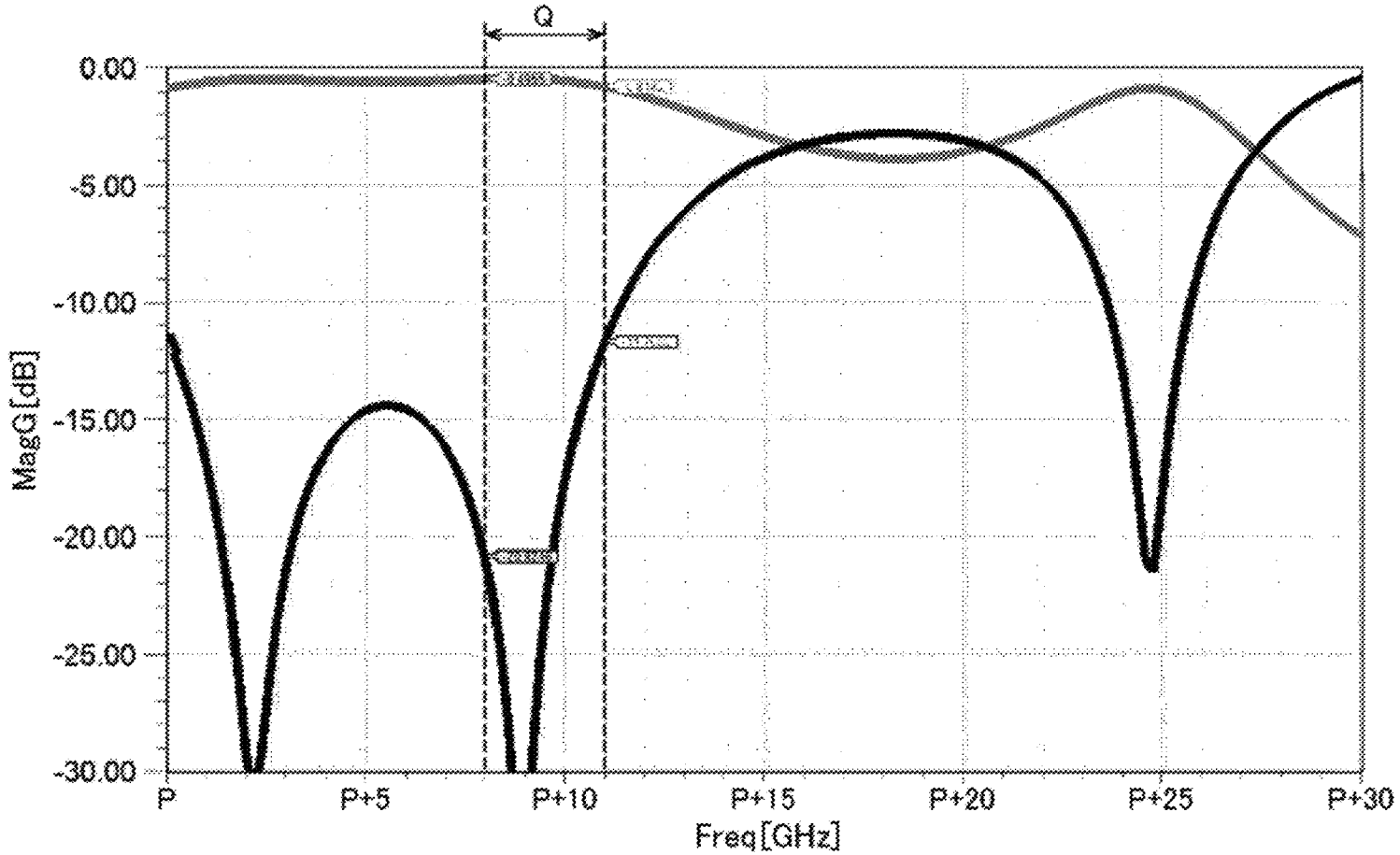
FIG. 29 is a diagram illustrating a simulation result of the six-layer structure.

Passing power characteristics [arg(G21) between the lower surface and the upper surface of a structure] of three-dimensional unit cells corresponding to the two three-dimensional unit cells exhibiting a steep frequency response in the three-layer structure are illustrated in FIG. 28 and FIG. 29. Each diagram tells that a gentle frequency characteristic and high passing efficiency are achieved throughout the required bandwidth Q. Further, it is also observed that sufficient impedance matching is achieved.

Note that, while an example of causing a three-layer structure to cover a range of 180 degrees and covering a range of 360 degrees with a six-layer structure in which two three-layer structures are laminated has been described, a range covered by a three-layer structure may be decreased and the range of 360 degrees may be covered by laminating a greater number of three-layer structures. For example, a range of 120 degrees may be covered by a three-layer structure, and the range of 360 degrees may be covered by laminating three three-layer structures. However, a greater number of laminated layers causes increase in thickness of the phase control plate and hinders thinning of a device. The six-layer structure contributes to thinning of a device while achieving a sufficient characteristic as described above.

In a case of a phase control plate in which two layers of admittance sheets with the same admittance $Y_0$ are laminated at a sufficiently close distance, it is known that equivalent performance can be achieved even when the two layers of admittance sheets are replaced by a single-layer admittance sheet with the admittance $Y_0$. Therefore, equivalent performance can be achieved in a structure ($Y_1/Y_2/Y_3/Y_2/Y_1$) configured by replacing the two layers in the middle in a six-layer structure with the aforementioned symmetric structure ($Y_1/Y_2/Y_3/Y_3/Y_2/Y_1$) with a single layer.

In other words, a phase control plate including five layers of admittance sheets and four layers of dielectric layers that are alternately laminated can achieve performance equivalent to that of the aforementioned phase control plate including six layers of admittance sheets and five layers of dielectric layers that are alternately laminated. The same applies to a laminated structure including more layers.

Further, a two-layer structure in which two layers of admittance sheets and a single-layer dielectric layer are laminated may cover a range of 180 degrees, and a four-layer structure in which two two-layer structures are laminated may cover a range of 360 degrees, according to the present example embodiment. In this case, advantageous effects similar to those of the six-layer structure can also be acquired.

Second Example Embodiment

A phase control plate according to the present example embodiment has a distinctive arrangement of three-dimensional unit cells. Details will be described below.

Figure 19:
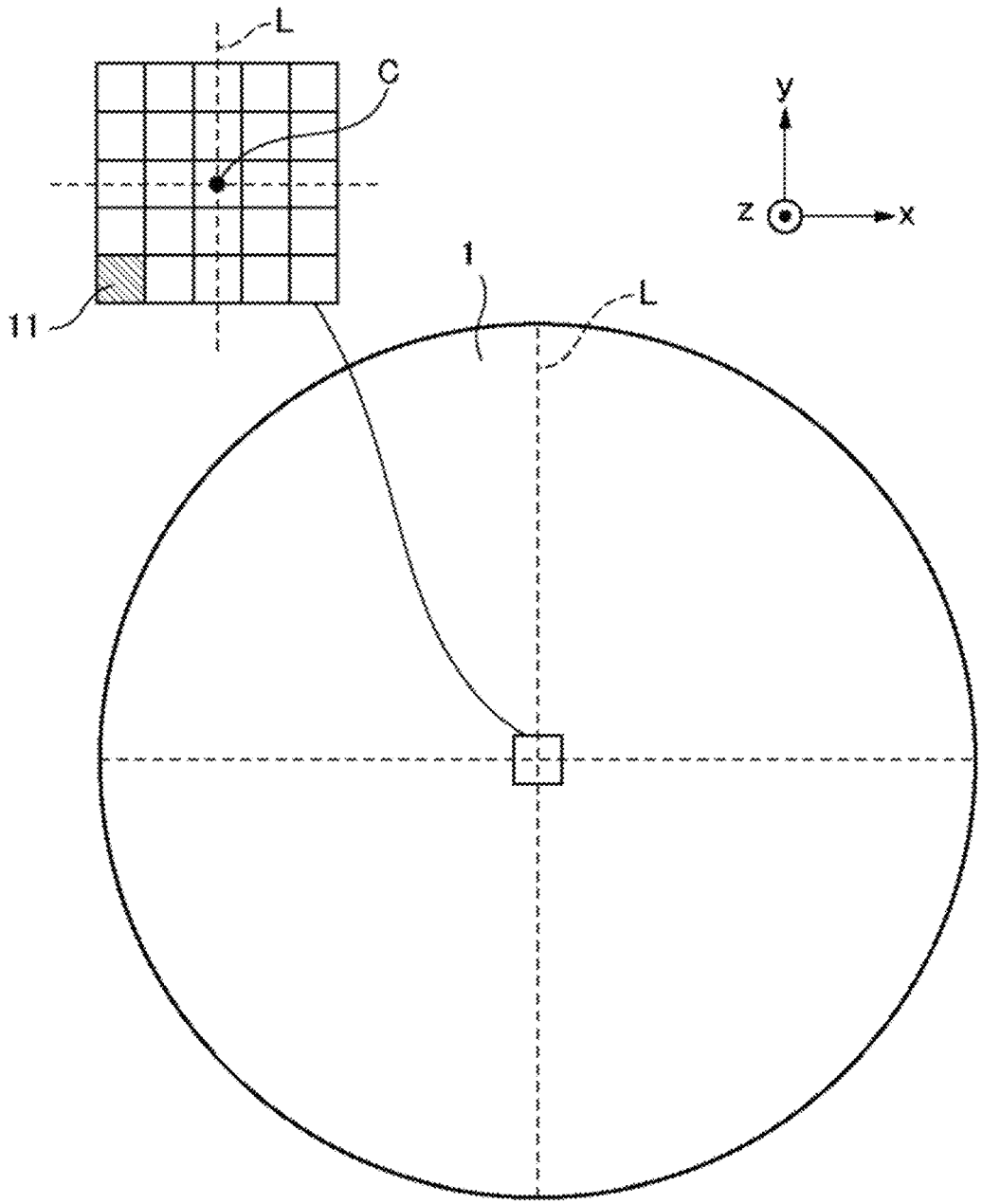
FIG. 19 is a diagram for illustrating an example of an arrangement of three-dimensional unit cells.
Figure 20:
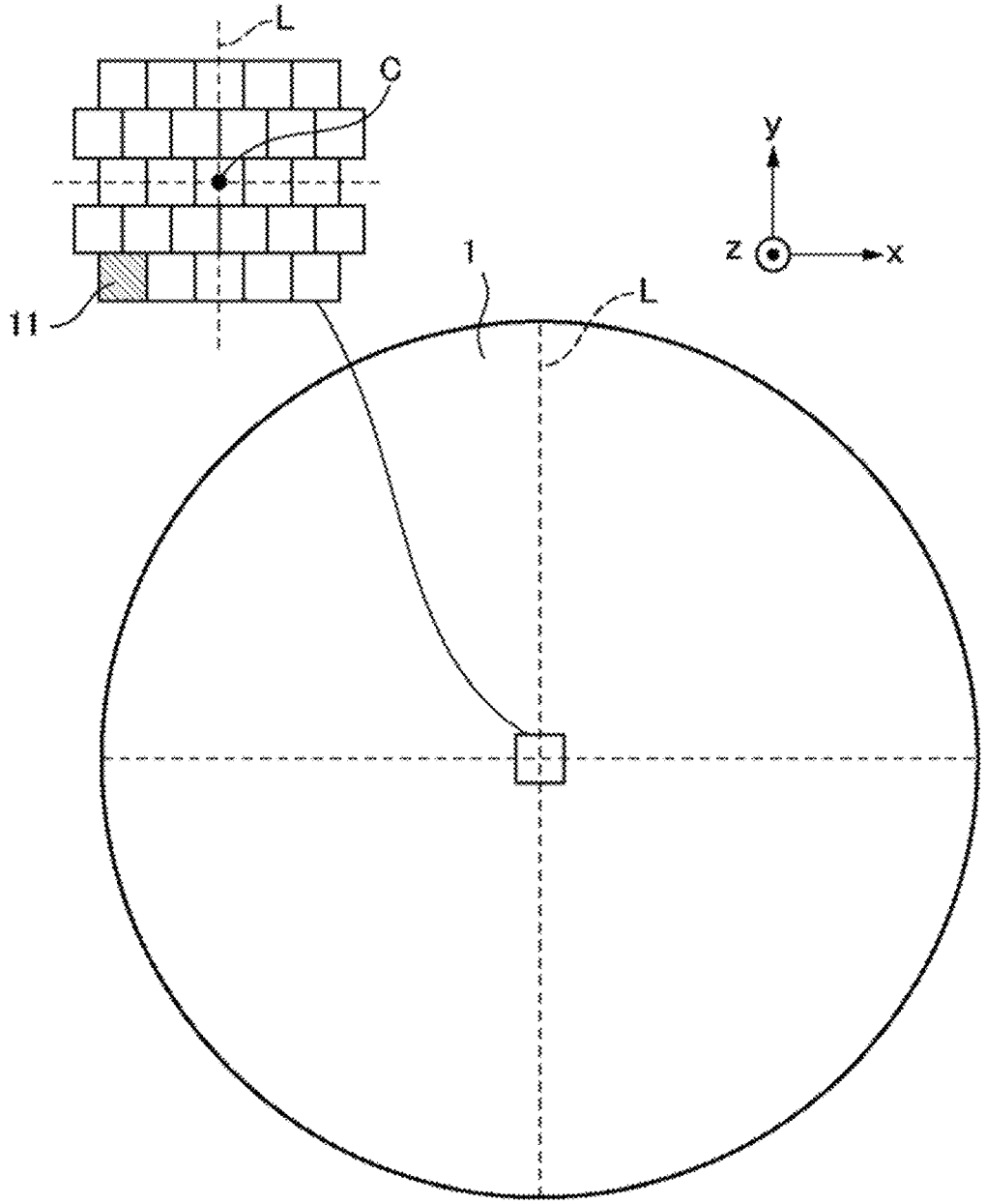
FIG. 20 is a diagram for illustrating an example of an arrangement of three-dimensional unit cells.
Figure 21:
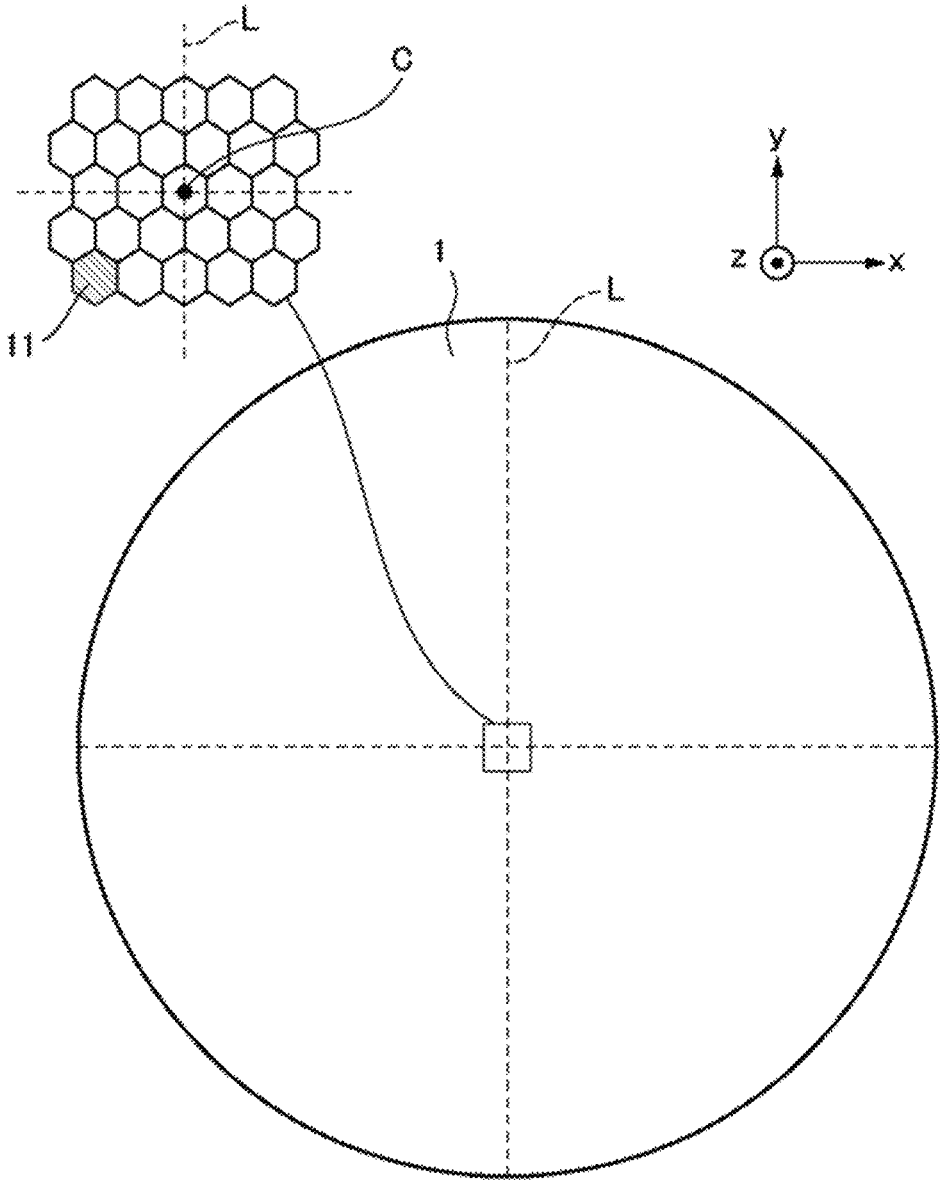
FIG. 21 is a diagram for illustrating an example of an arrangement of three-dimensional unit cells.
Figure 22:
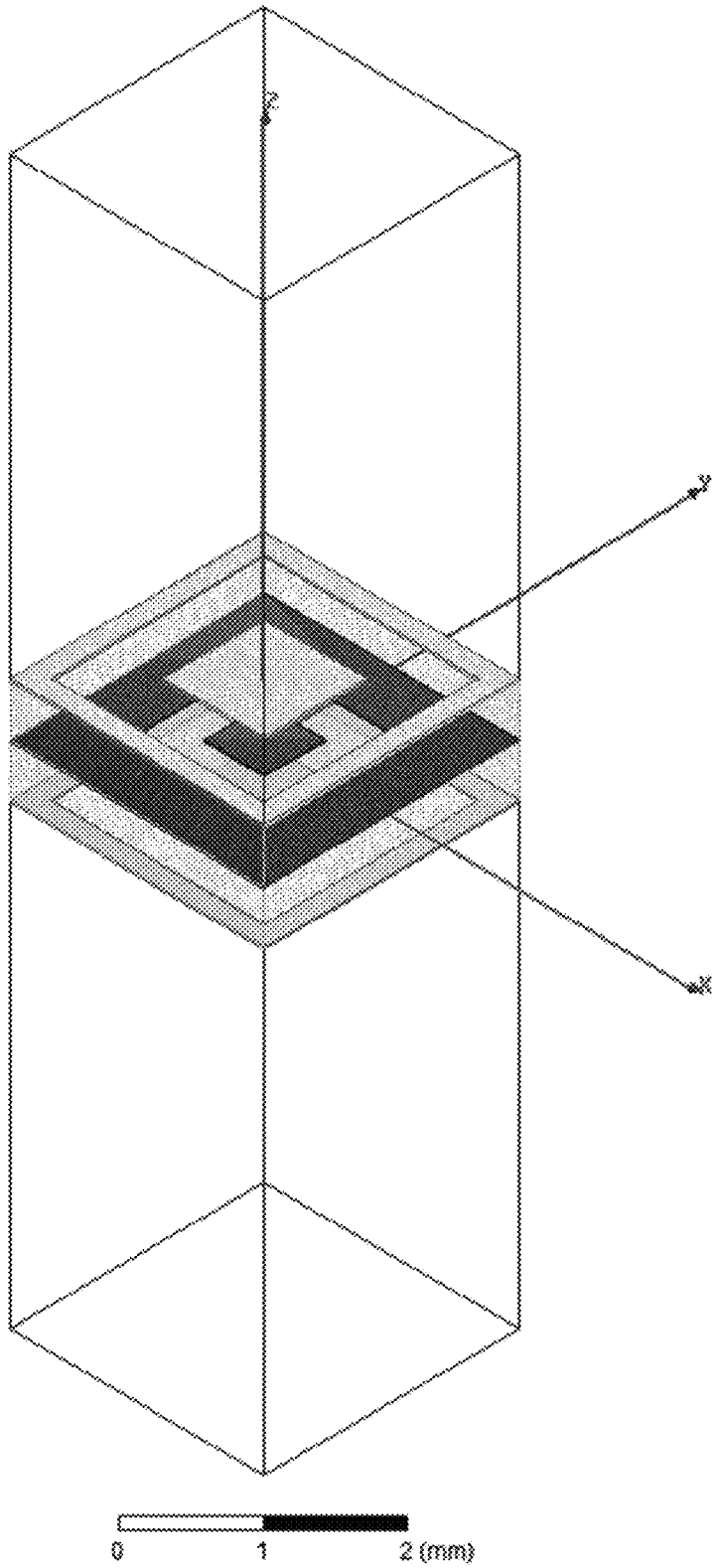
FIG. 22 is a diagram illustrating an example of a three-layer structure.

FIG. 19 to FIG. 21 illustrate examples of a plan view of a phase control plate 1. As illustrated, a phase control plate 1 includes a plurality of three-dimensional unit cells 11, and the plurality of three-dimensional unit cells 11 are arranged two-dimensionally.

In the example in FIG. 19, a plane shape of a three-dimensional unit cell 11 is a quadrangle, and a plurality of three-dimensional unit cells 11 are linearly arranged in longitudinal and lateral directions. In the example in FIG. 20, a plane shape of a three-dimensional unit cell 11 is a quadrangle, and a plurality of three-dimensional unit cells 11 are arranged in a houndstooth pattern. In the example in FIG. 21, a plane shape of a three-dimensional unit cell 11 is a hexagon, and a plurality of three-dimensional unit cells 11 are arranged in a houndstooth pattern. Note that the illustrated examples are strictly examples and do not limit the three-dimensional unit cell 11.

According to the present example embodiment, each of n layers ($n \geq 4$) of admittance sheets includes a representative point (for example, the center of a plane shape), and the admittance sheets are laminated in such a way that representative points overlap one another in plan view. In the illustrated examples, a point C is a representative point.

The phase control plate 1 is provided by arranging three-dimensional unit cells 11 giving different phase delays according to a distance from the representative point C. For example, the phase control plate 1 may be provided by arranging three-dimensional unit cells 11 in such a way that an amount of phase delay increases as a distance from the representative point C increases (toward the edge of the phase control plate 1). Note that the phase control plate 1 may also be provided by arranging three-dimensional unit cells 11 in such a way that an amount of phase delay decreases as a distance from the representative point C increases. An amount of phase delay refers to the difference in a phase of an electromagnetic wave between an incidence plane and an emission plane of the phase control plate 1.

For example, a reference point (for example, the center of a surface of a three-dimensional unit cell 11) is defined for each of a plurality of three-dimensional unit cells 11 arranged as illustrated in FIG. 19 to FIG. 21, and a distance N between the reference point and the representative point C is computed with respect to each three-dimensional unit cell 11. Then, a plurality of three-dimensional unit cells 11 are grouped according to a value of N. For example, three-dimensional unit cells 11 satisfying each of a plurality of numerical conditions such as $n0 \leq N \leq n1$, $n1 < N \leq n2$, $n2 < N \leq n3$, . . . may belong to the same group. Then, a plurality of three-dimensional unit cells 11 in the same group give the same phase delay. Consequently, groups of three-dimensional unit cells 11 each of which gives the same phase delay can be concentrically arranged around the representative point C.

For example, an amount of phase delay of an electromagnetic wave when the electromagnetic wave passes through a three-dimensional unit cell 11 in each group is increased as a value of N increases in such a manner as $n0 \leq N \leq n1$, $n1 < N \leq n2$, $n2 < N \leq n3$, . . . , or a distance from the representative point C increases. In addition, an amount of phase delay of an electromagnetic wave when the electromagnetic wave passes through a three-dimensional unit cell 11 in each group may be decreased as a value of N increases. Note that a phase range is not limited to a range from 0 to 360 degrees.

The phase control plate according to the present example embodiment described above can achieve advantageous effects similar to those of the first example embodiment. Further, the phase control plate according to the present example embodiment has a phase control function equivalent to a convex lens and a concave lens.

Third Example Embodiment

A phase control plate according to the present example embodiment has a distinctive arrangement of three-dimensional unit cells. Details will be described below.

FIG. 19 to FIG. 21 illustrate examples of a plan view of a phase control plate 1. As illustrated, a phase control plate 1 includes a plurality of three-dimensional unit cells 11, and the plurality of three-dimensional unit cells 11 are arranged two-dimensionally.

According to the present example embodiment, each of n layers ($n \geq 4$) of admittance sheets includes a representative line (for example, a straight line passing through the center of a plane shape), and the admittance sheets are laminated in such a way that representative lines overlap one another in plan view. In the illustrated examples, a line L is a representative line.

The phase control plate 1 is provided by arranging three-dimensional unit cells 11 giving different phase delays according to a distance from the representative line L. For example, the phase control plate 1 may be provided by arranging three-dimensional unit cells 11 in such a way that an amount of phase delay increases as a distance from the representative line L increases (as a distance from the representative line L increases in a direction perpendicular to the representative line L). Note that the phase control plate 1 may also be provided by arranging three-dimensional unit cells 11 in such a way that an amount of phase delay decreases as a distance from the representative line L increases. An amount of phase delay refers to the difference in a phase of an electromagnetic wave between an incidence plane and an emission plane of the phase control plate 1.

For example, a reference point (for, example, the center of a surface of a three-dimensional unit cell 11) is defined for each of a plurality of three-dimensional unit cells 11 arranged as illustrated in FIG. 19 to FIG. 21, and a distance N between the reference point and the representative line L (a distance between a point and a line) is computed with respect to each three-dimensional unit cell 11. Then, a plurality of three-dimensional unit cells 11 are grouped according to a value of N. For example, three-dimensional unit cells 11 satisfying each of a plurality of numerical conditions such as $n0 \leq N \leq n1$, $n1 < N \leq n2$, $n2 < N \leq n3$, . . . may belong to the same group. Then, a plurality of three-dimensional unit cells 11 in the same group give the same phase delay. Consequently, a group of three-dimensional unit cells 11 giving the same phase delay can be arranged in parallel with the representative line L.

For example, an amount of phase delay of an electromagnetic wave when the electromagnetic wave passes through a three-dimensional unit cell 11 in each group is increased as a value of N increases in such a manner as $n0 \leq N \leq n1$, $n1 < N \leq n2$, $n2 < N \leq n3$, . . . , or a distance from the representative line L increases. In addition, an amount of phase delay of an electromagnetic wave when the electromagnetic wave passes through a three-dimensional unit cell 11 in each group may be decreased as a value of N increases. Note that a phase range is not limited to a range from 0 to 360 degrees.

The phase control plate according to the present example embodiment described above can achieve advantageous effects similar to those of the first example embodiment. Further, the phase control plate according to the present example embodiment has a beam refraction function of refracting a beam in a desired state.

Examples of reference embodiments are added below as supplementary notes.

1. A phase control plate including n layers ($n \geq 4$) of overlapping admittance sheets each of which includes a plurality of plane unit cells, in which an admittance of a first plane unit cell included in an admittance sheet in a layer a ($1 \leq a \leq n$) and an admittance of a second plane unit cell being included in an admittance sheet in a layer b ($1 \leq b \leq n$ and $b \neq a$) and overlapping the first plane unit cell are different from each other.

2. The phase control plate according to 1, further including a plurality of three-dimensional unit cells each of which is configured with a plurality of the plane unit cells overlapping one another, in which a difference between an admittance of the plane unit cell in a c-th layer ($1 \leq c \leq n$) and an admittance of the plane unit cell in an ($n-c+1$)-th layer is less than a reference value in at least one of the three-dimensional unit cells.

3. The phase control plate according to 1 or 2, further including a plurality of three-dimensional unit cells each of which is configured with a plurality of the plane unit cells overlapping one another, in which a metal pattern of the plane unit cell in a c-th layer ($1 \leq c \leq n$) and a metal pattern of the plane unit cell in an ($n-c+1$)-th layer are identical in at least one of the three-dimensional unit cells.

4. The phase control plate according to any one of 1 to 3, further including a plurality of three-dimensional unit cells each of which is configured with a plurality of the plane unit cells overlapping one another, in which each of the n layers of admittance sheets includes a representative point, the representative points overlapping one another, and an amount of phase delay of an electromagnetic wave when the electromagnetic wave passes through each of a plurality of the three-dimensional unit cells increases as a distance from the representative point increases.

5. The phase control plate according to any one of 1 to 3, further including a plurality of three-dimensional unit cells each of which is configured with a plurality of the plane unit cells overlapping one another, in which each of the n layers of admittance sheets includes a representative point, the representative points overlapping one another, and an amount of phase delay of an electromagnetic wave when the electromagnetic wave passes through each of a plurality of the three-dimensional unit cells decreases as a distance from the representative point increases.

6. The phase control plate according to any one of 1 to 3, further including a plurality of three-dimensional unit cells each of which is configured with a plurality of the plane unit cells overlapping one another, in which each of the n layers of admittance sheets includes a representative line, the representative lines overlapping one another, and an amount of phase delay of an electromagnetic wave when the electromagnetic wave passes through each of a plurality of the three-dimensional unit cells increases as a distance from the representative line increases.

7. The phase control plate according to any one of 1 to 3, further including a plurality of three-dimensional unit cells each of which is configured with a plurality of the plane unit cells overlapping one another, in which each of the n layers of admittance sheets includes a representative line, the representative lines overlapping one another, and an amount of phase delay of an electromagnetic wave when the electromagnetic wave passes through each of a plurality of the three-dimensional unit cells decreases as a distance from the representative line increases.

8. The phase control plate according to any one of 1 to 7, in which admittances of the n layers of admittance sheets are given in such a way that an off-diagonal element of a scattering coefficient formula G below acquired from an equivalent circuit diagram including the n layers of admittance sheets and (n−1) layers of dielectric layers positioned between the admittance sheets is equal to or greater than 0.8

[Math 8]

SCATTERING COEFFICIENT FORMULA (3)

$$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1},$$

in which $Z_S$ denotes a normalized impedance determined by an incidence angle of an electromagnetic wave with respect to the phase control plate and a space impedance of a space where the phase control plate is positioned, $Z_L$ denotes a normalized impedance determined by an emission angle of an electromagnetic wave with respect to the phase control plate and the space impedance, and $Z_{11}$ to $Z_{22}$ denote elements of a Z matrix determined by an ABCD matrix of each of the n layers of admittance sheets and an ABCD matrix of each of the (n−1) layers of dielectric layers.

What is claimed is:

1. A phase control plate comprising n layers (n≥4) of overlapping admittance sheets each of which comprises a plurality of plane unit cells, wherein an admittance of a first plane unit cell included in an admittance sheet in a layer a (1≤a≤n) and an admittance of a second plane unit cell being included in an admittance sheet in a layer b (1≤b≤n and b≠a) and overlapping the first plane unit cell are different from each other.

2. The phase control plate according to claim 1, further comprising a plurality of three-dimensional unit cells each of which is configured with a plurality of the plane unit cells overlapping one another, wherein a difference between an admittance of the plane unit cell in a c-th layer (1≤c≤n) and an admittance of the plane unit cell in an (n−c+1)-th layer is less than a reference value in at least one of the three-dimensional unit cells.

3. The phase control plate according to claim 1, further comprising a plurality of three-dimensional unit cells each of which is configured with a plurality of the plane unit cells overlapping one another, wherein a metal pattern of the plane unit cell in a c-th layer (1≤c≤n) and a metal pattern of the plane unit cell in an (n−c+1)-th layer are identical in at least one of the three-dimensional unit cells.

4. The phase control plate according to claim 1, further comprising a plurality of three-dimensional unit cells each of which is configured with a plurality of the plane unit cells overlapping one another, wherein each of the n layers of admittance sheets includes a representative point, the representative points overlapping one another, and an amount of phase delay of an electromagnetic wave when the electromagnetic wave passes through each of a plurality of the three-dimensional unit cells increases as a distance from the representative point increases.

5. The phase control plate according to claim 1, further comprising a plurality of three-dimensional unit cells each of which is configured with a plurality of the plane unit cells overlapping one another, wherein each of the n layers of admittance sheets includes a representative point, the representative points overlapping one another, and an amount of phase delay of an electromagnetic wave when the electromagnetic wave passes through each of a plurality of the three-dimensional unit cells decreases as a distance from the representative point increases.

6. The phase control plate according to claim 1, further comprising a plurality of three-dimensional unit cells each of which is configured with a plurality of the plane unit cells overlapping one another, wherein each of the n layers of admittance sheets includes a representative line, the representative lines overlapping one another, and an amount of phase delay of an electromagnetic wave when the electromagnetic wave passes through each of a plurality of the three-dimensional unit cells increases as a distance from the representative line increases.

7. The phase control plate according to claim 1, further comprising a plurality of three-dimensional unit cells each of which is configured with a plurality of the plane unit cells overlapping one another, wherein each of the n layers of admittance sheets includes a representative line, the representative lines overlapping one another, and an amount of phase delay of an electromagnetic wave when the electromagnetic wave passes through each of a plurality of the three-dimensional unit cells decreases as a distance from the representative line increases.

8. The phase control plate according to claim 1, wherein admittances of the n layers of admittance sheets are given in such a way that an off-diagonal element of a scattering coefficient formula G below acquired from an equivalent circuit diagram comprising the n layers of admittance sheets and (n−1) layers of dielectric layers positioned between the admittance sheets is equal to or greater than 0.8

[Math. 8]

SCATTERING COEFFICIENT FORMULA (3)

$$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1},$$

wherein $Z_S$ denotes a normalized impedance determined by an incidence angle of an electromagnetic wave with respect to the phase control plate and a space impedance of a space where the phase control plate is positioned, $Z_L$ denotes a normalized impedance determined by an emission angle of an electromagnetic wave with respect to the phase control plate and the space impedance, and $Z_{11}$ to $Z_{22}$ denote elements of a Z matrix determined by an ABCD matrix of each of the n layers of admittance sheets and an ABCD matrix of each of the (n−1) layers of dielectric layers.

* * * * *